US008152594B2

(12) United States Patent
Saito et al.

(10) Patent No.: US 8,152,594 B2
(45) Date of Patent: Apr. 10, 2012

(54) POLISHING APPARATUS

(75) Inventors: Kenichiro Saito, Tokyo (JP); Osamu Nabeya, Tokyo (JP); Kimihide Nagata, Tokyo (JP); Tetsuji Togawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 894 days.

(21) Appl. No.: 12/010,738

(22) Filed: Jan. 29, 2008

(65) Prior Publication Data

US 2008/0287043 A1 Nov. 20, 2008

(30) Foreign Application Priority Data

Jan. 30, 2007 (JP) ..... 2007-019634

(51) Int. Cl.
*B24B 49/00* (2012.01)

(52) U.S. Cl. ..... 451/5; 451/8; 451/287

(58) Field of Classification Search ..... 451/5, 7, 451/8, 11, 285–290
See application file for complete search history.

(56) References Cited

U.S. PATENT DOCUMENTS

| | | | | |
|---|---|---|---|---|
| 5,975,994 | A * | 11/1999 | Sandhu et al. | 451/56 |
| 6,077,385 | A * | 6/2000 | Kimura et al. | 156/345.14 |
| 6,257,953 | B1 * | 7/2001 | Gitis et al. | 451/5 |
| 6,332,834 | B1 * | 12/2001 | Nukui et al. | 451/57 |
| 6,494,765 | B2 * | 12/2002 | Gitis et al. | 451/5 |
| 7,326,103 | B2 * | 2/2008 | Sakurai et al. | 451/10 |
| 2004/0038623 | A1 * | 2/2004 | Chandrasekaran | 451/5 |
| 2004/0121704 | A1 * | 6/2004 | Sakurai et al. | 451/5 |
| 2004/0180610 | A1 * | 9/2004 | Togawa | 451/41 |
| 2004/0192168 | A1 * | 9/2004 | Faustmann et al. | 451/5 |
| 2008/0070479 | A1 * | 3/2008 | Nabeya et al. | 451/8 |

FOREIGN PATENT DOCUMENTS

| | | |
|---|---|---|
| JP | 2004-154933 | 6/2004 |
| JP | 2006-128582 | 5/2006 |
| WO | 2004/113020 | 12/2004 |
| WO | 2006/049269 | 5/2006 |

OTHER PUBLICATIONS

Partial European Search Report issued May 26, 2008 in European Application No. 08001664.
Partial European Search Report issued Jul. 25, 2008 in European Application No. 08 00 1664.

* cited by examiner

*Primary Examiner* — Maurina Rachuba
(74) *Attorney, Agent, or Firm* — Wenderoth, Lind & Ponack, L.L.P.

(57) ABSTRACT

A polishing apparatus is used for polishing a substrate such as a semiconductor wafer to a flat mirror finish. The polishing apparatus includes a polishing table having a polishing surface, a top ring configured to hold and press the substrate against the polishing surface, a top ring shaft configured to lift and lower the top ring, and an elongation detecting device configured to detect an elongation of the top ring shaft. The polishing apparatus further includes a controller configured to set a vertical position of the top ring at the time of polishing, and control a lifting and lowering mechanism to lower the top ring to a preset polishing position as the set vertical position. The controller corrects the preset polishing position based on the elongation of the top ring shaft which has been detected by the elongation detecting device.

10 Claims, 22 Drawing Sheets

60
Hi
61
55
50
51
22
ΔH
Hw
ΔLd

POLISHING APPARATUS

BACKGROUND OF THE INVENTION

1. Field of the Invention

The present invention relates to a polishing apparatus, and more particularly to a polishing apparatus for polishing an object to be polished (substrate) such as a semiconductor wafer to a flat mirror finish.

2. Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In the chemical mechanical polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus includes a polishing table having a polishing surface formed by a polishing pad, and a substrate holding device, which is referred to as a top ring or a polishing head, for holding a substrate such as a semiconductor wafer. When a semiconductor wafer is polished with such a polishing apparatus, the semiconductor wafer is held and pressed against the polishing surface under a predetermined pressure by the substrate holding device. At this time, the polishing table and the substrate holding device are moved relative to each other to bring the semiconductor wafer into sliding contact with the polishing surface, so that the surface of the semiconductor wafer is polished to a flat mirror finish.

In such polishing apparatus, if the relative pressing force applied between the semiconductor wafer, being polished, and the polishing surface of the polishing pad is not uniform over the entire surface of the semiconductor wafer, then the surface of the semiconductor wafer is polished insufficiently or excessively in different regions thereof depending on the pressing force applied thereto. It has been customary to uniformize the pressing force applied to the semiconductor wafer by providing a pressure chamber formed by an elastic membrane at the lower portion of the substrate holding device and supplying the pressure chamber with a fluid such as air to press the semiconductor wafer under a fluid pressure through the elastic membrane.

If the polishing apparatus polishes semiconductor wafers with a polishing pad made of synthetic resin, then the polishing pad is progressively worn each time it is dressed and with the passage of time. In order to keep the surface pressure distribution unchanged on the semiconductor wafer held by the top ring or the polishing head, it is necessary to keep the distance between the top ring or the polishing head and the polishing pad constant during polishing.

According to a polishing apparatus disclosed in Japanese laid-open patent publication No. 2004-154933, a polishing head holding a substrate such as a semiconductor wafer is lowered to bring the polishing head and a surface, to be polished, of the substrate into contact with a polishing pad. When the lower surface of a subcarrier (chucking plate) in the polishing head contacts the upper surface of an elastic membrane, the vertical position (height) of the polishing head is detected by a sensor, and the polishing head is lifted by a predetermined distance from the detected vertical position to keep the distance between the lower surface of the subcarrier and the upper surface of the elastic membrane, i.e., the distance between the lower surface of the subcarrier and the polishing pad constant. The sensor for detecting the vertical position of the polishing head is mounted on a shaft to which the polishing head is fixed, and a stopper is mounted on a support arm (fixed member) which holds the polishing head in its entirety. The sensor detects the vertical position (height) of the polishing head by detecting the distance between the sensor and the stopper.

According to a polishing apparatus disclosed in Japanese laid-open patent publication No. 2006-128582, a top ring holding a semiconductor wafer is lowered until the lower surface of the top ring is brought into contact with the polishing surface of a polishing pad, whereupon the position of the top ring is detected by a sensor or the like, and then the vertical position of the polishing surface of the polishing pad is grasped from the detected position of the top ring. This process is referred to as pad search. An optimum position for the top ring to take at the time of polishing is calculated from the grasped vertical position of the polishing surface. Since the polishing pad is worn because of prior polishing and dressing, the amount of wear of the polishing pad is measured and an optimum vertical position for the top ring to take at the time of polishing is calculated from the measured amount of wear of the polishing pad. A servomotor for lifting and lowering the top ring is energized to lower the top ring, and then de-energized when the top ring reaches the calculated optimum vertical position. In this manner, the top ring is controlled to keep the distance between the top ring and the polishing surface of the polishing pad constant.

In the polishing apparatus disclosed in Japanese laid-open patent publication No. 2004-154933, in order to keep the distance between the lower surface of the subcarrier and the upper surface of the elastic membrane, i.e., the distance between the lower surface of the subcarrier and the polishing pad constant, it is necessary prior to the polishing process to lower the polishing head holding the substrate to bring the polishing head and the surface, to be polished, of the substrate into contact with the polishing pad, measure the vertical position of the polishing head as the polishing head is into contact with the polishing pad, and then lift the polishing head by a predetermined distance. The time required to bring the polishing head into contact with the polishing pad and then lift the polishing head increases the overall polishing time of the polishing process, resulting in lowering the throughput of the polishing apparatus.

In the polishing apparatus disclosed in Japanese laid-open patent publication No. 2006-128582, the pad search in which the top ring holding the semiconductor wafer is lowered until the lower surface of the top ring is brought into contact with the polishing surface of the polishing pad, whereupon the position of the top ring is detected by the sensor, and then the vertical position of the polishing surface of the polishing pad is grasped from the detected position of the top ring is carried out. After the pad search, an optimum position for the top ring to take at the time of polishing is calculated from the grasped vertical position of the polishing surface. Since the polishing pad is worn because of prior polishing and dressing, the amount of wear of the polishing pad is measured and an optimum vertical position for the top ring to take in the polishing process is calculated from the measured amount of wear of the polishing pad. Based on the calculated optimum vertical position, the distance between the top ring and the polishing surface of the polishing pad is controlled so as to be constant. The time required to control the vertical position of the top ring before the polishing process is much shorter than with the polishing apparatus disclosed in Japanese laid-open patent publication No. 2004-154933. The applicant of the present application has employed a process of calculating and controlling an optimum vertical position for the top ring prior to the polishing process based on the amount of wear of the polishing pad. As the polishing apparatus is continuously operated to polish an increased number of substrates and the accumulated polishing time increases, the polishing profile of substrates changes.

The inventors of the present invention have conducted various experiments and analyzed the experimental results for the purpose of finding out why the polishing profile of substrates changes during the continuous operation of the polishing apparatus. As a result, it has been discovered that a top ring shaft for holding the top ring and lifting and lowering the top ring tends to extend due to a temperature rise caused by the friction of a rotational holding portion, and thus the top ring is located at a position lower than the optimum vertical position of the top ring which has been calculated.

In both of the polishing apparatus disclosed in Japanese laid-open patent publication No. 2004-154933 and the polishing apparatus disclosed in Japanese laid-open patent publication No. 2006-128582, the pad search is carried out to bring the polishing head or the top ring holding the semiconductor wafer into contact with the polishing pad for obtaining an optimum vertical position (preset polishing position) of the polishing head or the top ring in the polishing process. During the pad search, the semiconductor wafer and the subcarrier (chucking plate) tend to contact each other through the elastic membrane. At this time, since a force of about 1500 N at maximum is applied to a local area of the semiconductor wafer, devices fabricated on the semiconductor wafer may possibly be damaged or broken.

Specifically, the top ring shaft for lifting and lowering the top ring or the polishing head is actuated by a ball screw, a motor, and gears for precision feeding. Therefore, the gears, the ball screw, and other mechanical parts tend to cause a large mechanical loss. When the top ring shaft is actuated for precision feeding, a certain torque limit is imposed on the motor. However, if the motor is operated at a low torque to feed the top ring shaft, then the motor may stall due to an instantaneous large mechanical loss. The torque range for reliably feeding the top ring shaft is from about 25% to 30% of the maximum torque value of the motor. When the top ring is brought into contact with the polishing pad while the top ring shaft is being fed under a motor torque which is 30% of the maximum torque value, a load of about 1500 N at maximum is imposed on the top ring shaft. Unlike application of uniform pressure to the semiconductor wafer by the pressure chamber formed by the elastic membrane, this load is applied to a local area of the semiconductor wafer as a product wafer, rather than its entire surface. Thus, devices fabricated on the semiconductor wafer are likely to be broken by this load. In order to prevent such device damage, a dummy wafer may be used instead of the product wafer when the polishing head or the top ring is brought into contact with the polishing pad. However, it needs extra work to install the dummy wafer on the polishing head or the top ring and de-install the dummy wafer from the polishing head or the top ring, and the extra work is responsible for reducing the throughput. Accordingly, there is a demand for a polishing apparatus which minimizes the pad search for determining an optimum vertical position of the polishing head or the top ring at the time of polishing.

SUMMARY OF THE INVENTION

It is therefore an object of the present invention to provide a polishing apparatus which minimizes a process of bringing a top ring into contact with a polishing surface in order to detect the vertical position of the top ring or the vertical position of the polishing surface prior to a polishing process, for thereby increasing a throughput, and which is capable of keeping the top ring in an optimum position at the time of polishing even if a top ring shaft that holds the top ring is extended due to a temperature rise, while dealing with a change in the top ring shaft due to a temperature rise during polishing.

Another object of the present invention is to provide a polishing apparatus which can prevent a top ring shaft holding a top ring from increasing its temperature even if the polishing apparatus is in continuous operation.

Still another object of the present invention is to provide a polishing apparatus which keeps a polishing profile constant even if the resiliency (elasticity) of a polishing pad varies due to wear of the polishing pad.

In order to achieve the above objects, according to a first aspect of the present invention, there is provided a polishing apparatus comprising: a polishing table having a polishing surface; a top ring configured to hold and press a substrate against the polishing surface; a top ring shaft configured to lift and lower the top ring; a lifting and lowering mechanism configured to lift and lower the top ring shaft; an elongation detecting device configured to detect an elongation of the top ring shaft; and a controller configured to set a vertical position of the top ring at the time of polishing, and control the lifting and lowering mechanism to lower the top ring to a preset polishing position as the set vertical position; wherein the controller corrects the preset polishing position based on the elongation of the top ring shaft which has been detected by the elongation detecting device.

According to the present invention, the elongation of the top ring shaft, which is a factor that affects the preset polishing position of the top ring, is detected, and the preset polishing position of the top ring is corrected in order to cancel out the detected elongation of the top ring shaft. Therefore, the top ring can be maintained in an optimum position at all times when the substrate is polished. Accordingly, the surface pressure applied to the substrate held by the top ring is kept at a uniform level.

In a preferred aspect of the present invention, a polishing apparatus further comprises a position detecting device configured to detect a vertical position of the top ring when a lower surface of the top ring or a lower surface of the substrate held by the top ring is brought into contact with the polishing surface; wherein the controller calculates the preset polishing position from the vertical position of the top ring which has been detected by the position detecting device.

According to the present invention, the top ring which is holding the substrate, e.g., a semiconductor wafer, is lowered, and when the lower surface of the top ring or the lower surface of the substrate held by the top ring is brought into contact with the polishing surface, e.g., a polishing pad, the position of the top ring is detected by the position detecting device such as a sensor. Then, the vertical position (height) of the surface of the polishing pad is detected from the detected position of the top ring. That is, the pad search is carried out. The preset polishing position of the top ring at the time the substrate is polished is calculated from the detected vertical position of the surface of the polishing pad. Therefore, when the polishing pad is replaced, the preset polishing position of the top ring at the time of polishing can accurately be established.

In a preferred aspect of the present invention, a polishing apparatus further comprises a dresser for dressing the polishing surface comprising a polishing pad; and a wear detecting device configured to detect an amount of wear of the polishing pad; wherein the controller corrects the preset polishing position based on the amount of wear of the polishing pad which has been detected by the wear detecting device, and the elongation of the top ring shaft.

According to the present invention, both the amount of wear of the polishing pad and the elongation of the top ring shaft, which are factors that affect the preset polishing position of the top ring, are detected, and the preset polishing position of the top ring is corrected in order to cancel out the detected amount of wear of the polishing pad and the detected elongation of the top ring shaft. Therefore, the top ring can be maintained in an optimum position at all times when the substrate is polished.

In a preferred aspect of the present invention, the preset polishing position ($H_{post\text{-}best}$) which has been corrected based on the amount of wear of the polishing pad and the elongation of the top ring shaft is expressed as $H_{post\text{-}best}=H_{initial\text{-}best}+\Delta H-\Delta L$, where $H_{initial\text{-}best}$ represents the preset polishing position of the top ring before the polishing pad is worn, $\Delta H$ the amount of wear of the polishing pad, and $\Delta L$ the elongation of the top ring shaft.

In a preferred aspect of the present invention, the preset polishing position ($H_{post\text{-}best}$) which has been corrected based on the amount of wear of the polishing pad and the elongation of the top ring shaft is expressed as $H_{post\text{-}best}=H_{initial\text{-}best}+C\Delta H-\Delta L$, where $H_{initial\text{-}best}$ represents the preset polishing position of the top ring before the polishing pad is worn, $C\Delta H$ the product of the amount of wear $\Delta H$ of the polishing pad and an adjustment coefficient C in the range of $0\leqq C<1$ or $1<C\leqq 2$, and $\Delta L$ the elongation of the top ring shaft.

In a preferred aspect of the present invention, the top ring includes an elastic membrane configured to contact the substrate, the elastic membrane providing a pressure chamber for being supplied with a pressurized fluid; the elastic membrane presses the substrate against the polishing surface under a fluid pressure when the pressure chamber is supplied with the pressurized fluid; and each of the preset polishing position and the corrected preset polishing position represents such a position that a gap is defined between a lower surface of the substrate held by the top ring and the polishing surface before the pressure chamber is supplied with the pressurized fluid.

In a preferred aspect of the present invention, the elongation detecting device comprises: a temperature sensor for measuring the temperature of the top ring shaft; and a calculating device configured to calculate the elongation of the top ring shaft from a change in the temperature measured by the temperature sensor.

In a preferred aspect of the present invention, the elongation detecting device comprises a distance sensor.

In a preferred aspect of the present invention, a polishing apparatus further comprises a top ring head supporting the top ring shaft; wherein the distance sensor is fixedly mounted on the top ring head for measuring the distance between the distance sensor and an upper surface of the top ring.

In a preferred aspect of the present invention, a polishing apparatus further comprises a substrate transfer device for transferring the substrate to or from the top ring; wherein the distance sensor is provided on or near the substrate transfer device for measuring the position of the top ring when the substrate is transferred to or from the top ring.

In a preferred aspect of the present invention, the wear detecting device comprises a sensor for detecting a vertical position of the dresser when the dresser is brought in contact with the polishing pad.

In a preferred aspect of the present invention, the wear detecting device determines the amount of wear of the polishing pad in consideration of an elongation of the dresser shaft.

In a preferred aspect of the present invention, the lifting and lowering mechanism includes a motor, and the position detecting device comprises a current detector for detecting a current flowing through the motor to detect when the lower surface of the top ring or the lower surface of the substrate held by the top ring is brought into contact with the polishing surface, based on a change in the current detected by the current detector.

In a preferred aspect of the present invention, the top ring holds a dummy wafer as the substrate when the position detecting device detects the position of the top ring.

According to a second aspect of the present invention, there is provided a polishing apparatus comprising: a polishing table having a polishing pad; a top ring configured to hold and press a substrate against the polishing pad; a top ring shaft configured to lift and lower the top ring; the top ring shaft; a wear detecting device configured to detect an amount of wear of the polishing pad; and a controller configured to set a vertical position of the top ring at the time of polishing, and control the lifting and lowering mechanism to lower the top ring to a preset polishing position as the set vertical position; wherein the controller corrects the preset polishing position based on a value produced by multiplying the amount of wear of the polishing pad which has been detected by the wear detecting device, by an adjustment coefficient (C) in the range of $0\leqq C<1$ or $1<C\leqq 2$.

According to the present invention, the amount of wear ($\Delta H$) of the polishing pad is multiplied by an adjustment coefficient (C) in the range of $0\leqq C<1$ or $1<C\leqq 2$ depending on the type of the polishing pad and a polishing process to produce the product $C\Delta H$, the preset polishing position of the top ring which has been set is corrected using the value $C\Delta H$ which is smaller or larger than the actual amount of wear ($\Delta H$). Thus, even if the polishing pad is subjected to the change of elasticity, the top ring can be maintained in an optimum position at all times when the substrate is polished.

In a preferred aspect of the present invention, a polishing apparatus further comprises a position detecting device configured to detect a vertical position of the top ring when a lower surface of the top ring or a lower surface of the substrate held by the top ring is brought into contact with the polishing pad; wherein the controller calculates the preset polishing position from the vertical position of the top ring which has been detected by the position detecting device.

In a preferred aspect of the present invention, the adjustment coefficient (C) varies depending on at least one of the thickness of the polishing pad, the type of the polishing pad, the type of a film of the substrate to be polished, and a polishing pressure under which the substrate is polished.

According to a third aspect of the present invention, there is provided a polishing apparatus comprising: a polishing table having a polishing surface; a top ring configured to hold and press a substrate against the polishing surface; a top ring shaft configured to lift and lower the top ring; a lifting and lowering mechanism configured to lift and lower the top ring shaft; a cooling device configured to cool the top ring shaft; and a controller configured to set a vertical position of the top ring at the time of polishing and control the lifting and lowering mechanism to lower the top ring to a preset polishing position as the set vertical position.

According to the present invention, since the temperature of the top ring shaft which is holding the top ring is prevented from rising even when the polishing apparatus is in continuous operation, the top ring can be maintained in an optimum position at all times when the substrate is polished.

In a preferred aspect of the present invention, a polishing apparatus further comprises a position detecting device configured to detect a vertical position of the top ring when a lower surface of the top ring or a lower surface of the substrate held by the top ring is brought into contact with the polishing surface; wherein the controller calculates the preset polishing position from the vertical position of the top ring which has been detected by the position detecting device.

In a preferred aspect of the present invention, a polishing apparatus further comprises a dresser for dressing the polishing surface comprising a polishing pad; and a wear detecting device configured to detect an amount of wear of the polishing pad; wherein the controller corrects the preset polishing position based on the amount of wear of the polishing pad which has been detected by the wear detecting device.

In a preferred aspect of the present invention, the cooling device comprises a passage formed in the top ring shaft and a supply device configured to supply a coolant to the passage.

According to a fourth aspect of the present invention, there is provided a polishing apparatus comprising: a polishing table having a polishing surface; a dresser dressing the polishing surface; a wear detecting device configured to detect an amount of wear of the polishing surface during each of a dressing operation by the dresser; wherein the wear detecting device determines nth-amount of wear of the polishing surface by averaging the vertical position of the polishing surface or the amount of wear of the polishing surface obtained from (n−m) times of dressing to n times of dressing.

Preferably, dressing operation is conducted each time after one substrate is polished.

In a preferred aspect of the present invention, the wear detecting device determines the amount of wear of the polishing surface by change of the vertical position of the dresser when the dresser is brought into contact with the polishing surface.

According to a fifth aspect of the present invention, there is provided a polishing apparatus comprising: a polishing table having a polishing surface; a top ring configured to hold and press a substrate against the polishing surface; a top ring shaft configured to lift and lower the top ring; a lifting and lowering mechanism configured to lift and lower the top ring shaft; a position detecting device configured to detect a vertical position of the top ring when a lower surface of the top ring or a lower surface of the substrate held by the top ring is brought into contact with the polishing surface; wherein contacting operation of bringing the top ring into contact with the polishing surface is performed at plural different positions on the polishing surface, and the vertical position of the polishing surface is determined by averaging vertical positions of the polishing surface obtained by plural times of contacting operation.

According to a sixth aspect of the present invention, there is provided a polishing apparatus comprising: a polishing table having a polishing surface; a dresser configured to hold and press a substrate against the polishing surface; a dresser shaft configured to lift and lower the dresser; a lifting and lowering mechanism configured to lift and lower the dresser shaft; a position detecting device configured to detect a vertical position of the dresser when a lower surface of the dresser is brought into contact with the polishing surface; wherein contacting operation of bringing the dresser into contact with the polishing surface is performed at plural different positions on the polishing surface, and the vertical position of the polishing surface is determined by averaging vertical positions of the polishing surface obtained by plural times of contacting operation.

According to the present invention, the elongation of the top ring shaft, which is a factor that affects the preset polishing position of the top ring, is detected, and the preset polishing position of the top ring which has been set is corrected in order to cancel out the detected elongation of the top ring shaft. Therefore, the top ring can be maintained in an optimum position at all times when the substrate is polished. Accordingly, it is possible to solve the problem of the conventional polishing apparatus that the polishing profile of substrate varies as the number of polished substrates increases and the accumulated polishing time increases while the polishing apparatus is in continuous operation.

Heretofore, when the elongation of the top ring shaft is to be adjusted, such elongation is corrected by the pad search which requires the top ring to contact the polishing surface. The polishing apparatus according to the present invention can dispence with such a correcting process.

According to the present invention, both the amount of wear of the polishing pad and the elongation of the top ring shaft, which are factors that affect the preset polishing position of the top ring, are detected, and the preset polishing position of the top ring is corrected in order to cancel out the detected amount of wear of the polishing pad and the detected elongation of the top ring shaft. Therefore, the top ring can be maintained in an optimum position at all times when the substrate is polished.

According to the present invention, since the temperature of the top ring which is holding the top ring is prevented from rising even when the polishing apparatus is in continuous operation, the top ring can be maintained in an optimum position at all times when the substrate is polished. Therefore, the polishing profile of substrate is prevented from varying even when the polishing apparatus is in continuous operation.

According to the present invention, the polishing apparatus is capable of coping with a change in the pressure distribution over the substrate caused by a change in the rebound of the polishing pad because of a change in the elasticity of the polishing pad caused by a change in the thickness of the polishing pad. Specifically, when the polishing pad is worn, the vertical position of the top ring can be adjusted to a position depending on the type of the polishing pad, the type of a film of the substrate to be polished, and the polishing pressure under which the substrate is polished.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
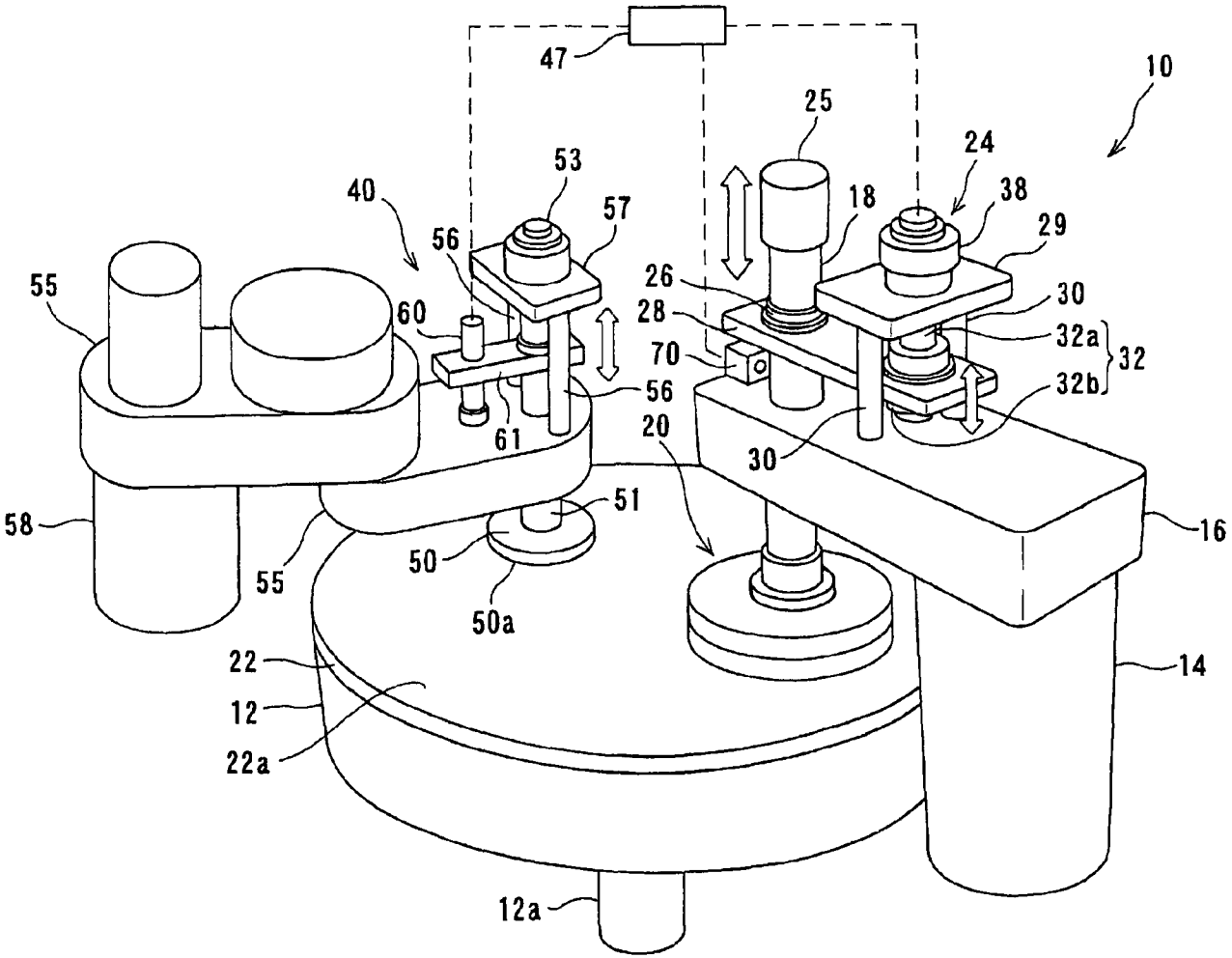
FIG. 1 is a schematic perspective view showing a polishing apparatus according to a first embodiment of the present invention.

A polishing apparatus according to embodiments of the present invention will be described below with reference to FIGS. 1 through 18. Like or corresponding parts are denoted by like or corresponding reference numerals throughout drawings and will not be described below repetitively.

FIG. 1 is a schematic view showing a polishing apparatus 10 according to a first embodiment of the present invention. As shown in FIG. 1, the polishing apparatus 10 has a polishing table 12, a top ring head 16 connected to an upper end of a support shaft 14, a top ring shaft 18 mounted at a free end of the top ring head 16, and a top ring 20 coupled to a lower end of the top ring shaft 18. In the illustrated example, the top ring 20 is substantially in the form of a circular plate. The top ring shaft 18 is coupled to a top ring rotating motor through a coupling device such as a timing belt, and thus the top ring shaft 18 is rotatable. However, in FIG. 1, the top ring rotating motor, the timing belt, and the like are not illustrated.

The polishing table 12 is coupled via a table shaft 12*a* to a motor (not shown) disposed below the polishing table 12. Thus, the polishing table 12 is rotatable about the table shaft 12*a*. As shown in FIG. 1, a polishing pad 22 is attached to an upper surface of the polishing table 12. An upper surface 22*a* of the polishing pad 22 constitutes a polishing surface to polish a semiconductor wafer W.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single layer). Foam polyurethane is porous and has a large number of fine recesses or holes formed in its surface.

The top ring shaft 18 is rotated by actuation of a motor (not shown). By rotation of the top ring shaft 18, the top ring 20 is rotated about the top ring shaft 18. Further, the top ring shaft 18 is vertically moved with respect to the top ring head 16 by a vertical movement mechanism 24. By vertical movement of the top ring shaft 18, the top ring 20 is vertically moved with respect to the top ring head 16. A rotary joint 25 is mounted on an upper end of the top ring shaft 18.

The top ring 20 is configured to hold a substrate such as a semiconductor wafer W on its lower surface. The top ring head 16 is pivotable (swingable) about the support shaft 14. Thus, the top ring 20, which holds a semiconductor wafer W on its lower surface, is moved between a position at which the top ring 20 receives the semiconductor wafer W and a position above the polishing table 12 by pivotal movement of the top ring head 16. The top ring 20 is lowered to press the semiconductor wafer W against a surface (polishing surface) 22*a* of the polishing pad 22. At this time, while the top ring 20 and the polishing table 12 are respectively rotated, a polishing liquid is supplied onto the polishing pad 22 from a polishing liquid supply nozzle (not shown), which is provided above the polishing table 12. The semiconductor wafer W is brought into sliding contact with the polishing surface 22*a* on the polishing pad 22. Thus, a surface of the semiconductor wafer W is polished.

The vertical movement mechanism 24, which vertically moves the top ring shaft 18 and the top ring 20, has a bridge 28 supporting the top ring shaft 18 in a manner such that the top ring shaft 18 is rotatable via a bearing 26, a ball screw 32 mounted on the bridge 28, a support stage 29 which is supported by poles 30, and an AC servomotor 38 provided on the support stage 29. The support stage 29, which supports the servomotor 38, is fixed to the top ring head 16 via the poles 30.

The ball screw 32 has a screw shaft 32*a* which is coupled to the servomotor 38, and a nut 32*b* into which the screw shaft 32*a* is threaded. The top ring shaft 18 is configured to be vertically movable together with the bridge 28. Accordingly, when the servomotor 38 is driven, the bridge 28 is vertically moved through the ball screw 32. As a result, the top ring shaft 18 and the top ring 20 are vertically moved. The polishing apparatus 10 has a controller 47 for controlling various equipment including the servomotor 38 in the polishing apparatus 10.

The polishing apparatus 10 has a dressing unit 40 for dressing the polishing surface 22*a* on the polishing table 12. The dressing unit 40 includes a dresser 50 which is brought into sliding contact with the polishing surface 22*a*, a dresser shaft 51 to which the dresser 50 is connected, an air cylinder 53 provided at an upper end of the dresser shaft 51, and a swing arm 55 rotatably supporting the dresser shaft 51. The dresser 50 has a dressing member 50*a* attached on a lower portion of the dresser 50. The dressing member 50*a* has diamond particles in the form of needles. These diamond particles are attached on a lower of the dressing member 50*a*. The air cylinder 53 is disposed on a support stage 57, which is supported by poles 56. The poles 56 are fixed to the swing arm 55.

The swing arm 55 is pivotable (swingable) about the support shaft 58 by actuation of a motor (not shown). The dresser shaft 51 is rotatable by actuation of a motor (not shown). Thus, the dresser 50 is rotated about the dresser shaft 51 by rotation of the dresser shaft 51. The air cylinder 53 vertically moves the dresser 50 via the dresser shaft 51 so as to press the dresser 50 against the polishing surface 22*a* of the polishing pad 22 under a predetermined pressing force.

Dressing operation of the polishing surface 22*a* on the polishing pad 22 is performed as follows. The dresser 50 is pressed against the polishing surface 22*a* by the air cylinder 53. Simultaneously, pure water is supplied onto the polishing surface 22*a* from a pure water supply nozzle (not shown). In this state, the dresser 50 is rotated about the dresser shaft 51, and the lower surface (diamond particles) of the dressing member 50*a* is brought into contact with the polishing surface 22*a*. Thus, the dresser 50 removes a portion of the polishing pad 22 so as to dress the polishing surface 22*a*.

The polishing apparatus 10 in the present embodiment utilizes the dresser 50 to measure the amount of wear of the polishing pad 22. Specifically, the dressing unit 40 includes a displacement sensor (wear detecting device) 60 for measuring displacement of the dresser 50. The displacement sensor 60 is provided on an upper surface of the swing arm 55. A target plate 61 is fixed to the dresser shaft 51. The target plate 61 is vertically moved by vertical movement of the dresser 50. The displacement sensor 60 is inserted into a hole of the target plate 61. The displacement sensor 60 measures displacement of the target plate 61 to measure displacement of the dresser 50. The displacement sensor 60 may comprise any type of sensors including a linear scale sensor, a laser sensor, an ultrasonic sensor, and an eddy-current sensor.

In the present embodiment, the amount of wear of the polishing pad 22 is measured as follows. First, the air cylinder 53 is operated to bring the dresser 50 into contact with a polishing surface 22*a* of an unused polishing pad 22 which has been initially dressed. In this state, the displacement sensor 60 measures an initial position (initial height value) of the dresser 50 and stores the initial position (initial height value) in the storage device of the controller (arithmetical unit) 47. After completion of a polishing process for one or more semiconductor wafers W, the dresser 50 is brought into contact with the polishing surface 22*a*. In this state, the position of the dresser 50 is measured. Since the position of the dresser 50 is shifted downward by the amount of wear of the polishing pad 22, the controller 47 calculates a difference between the initial position and the measured position of the dresser 50 after polishing to obtain the amount of wear of the polishing pad 22. In this manner, the amount of wear of the polishing pad 22 is calculated based on the position of the dresser 50.

The dressing is performed in such a state that a large dresser larger than the semiconductor wafer W is located at a fixed position on the polishing surface or in such a state that a small dresser smaller than the semiconductor W is swung on the polishing surface. Hereinafter, the dressing by which the small dresser is swung on the polishing surface is referred to as "scan-dressing."

Next, a method for measuring the amount of wear of the polishing pad 22 in the scan-dressing will be described below.

Figure 19:
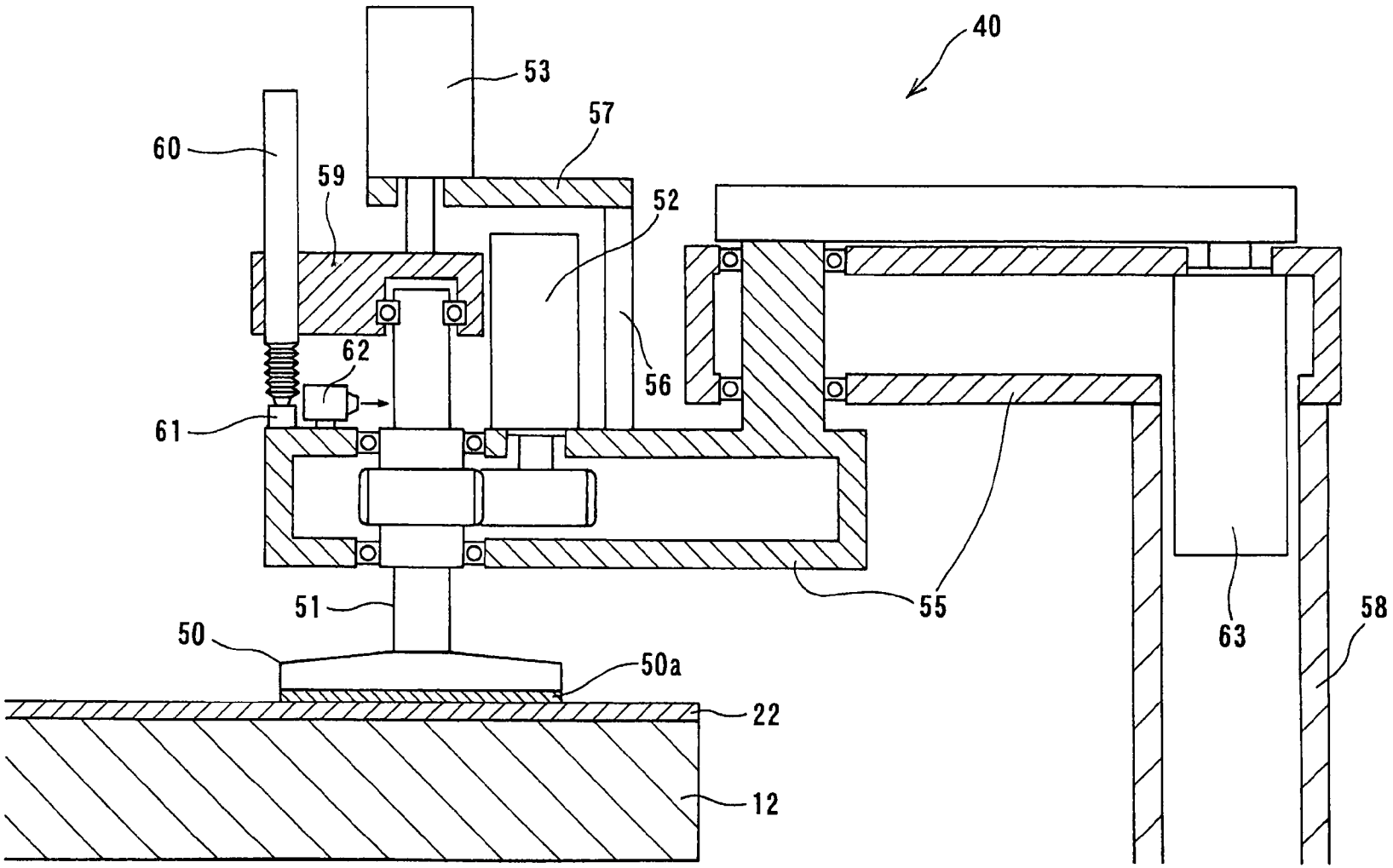
FIG. 19 is a schematic cross-sectional view showing the structure of the dressing unit for performing the scan-dressing.

FIG. 19 is a schematic cross-sectional view showing the structure of the dressing unit 40 for performing the scan-dressing. As shown in FIG. 19, the displacement sensor 60 is fixed to the support block 59 which is vertically moved by the air cylinder 53, and the dresser shaft 51 is fixed to the support block 59. The dresser 50 is rotated by a dresser rotating motor 52. By actuation of the air cylinder 53, the dresser 50, the dresser shaft 51, the support block 59 and the displacement sensor 60 are integrally moved vertically. In the support shaft 58, there is provided a dresser swing motor 63 for swinging the swing arm 55. The target plate 61 is provided on the upper surface of the swing arm 55, and thus the vertical position of the target plate 61 is regarded as a fixed vertical position. A temperature sensor 62 for measuring the temperature of the dresser shaft 51 is provided on the upper surface of the swing arm 55. The temperature sensor 62 comprises a radiation temperature sensor, and is placed so as to face the dresser shaft 51. Other structure of the dressing unit shown in FIG. 19 is the same as that of the dressing unit 40 shown in FIG. 1.

The dressing unit 40 shown in FIG. 19 performs dressing of the polishing pad 22 each time after one semiconductor wafer W is polished.

Figure 20:
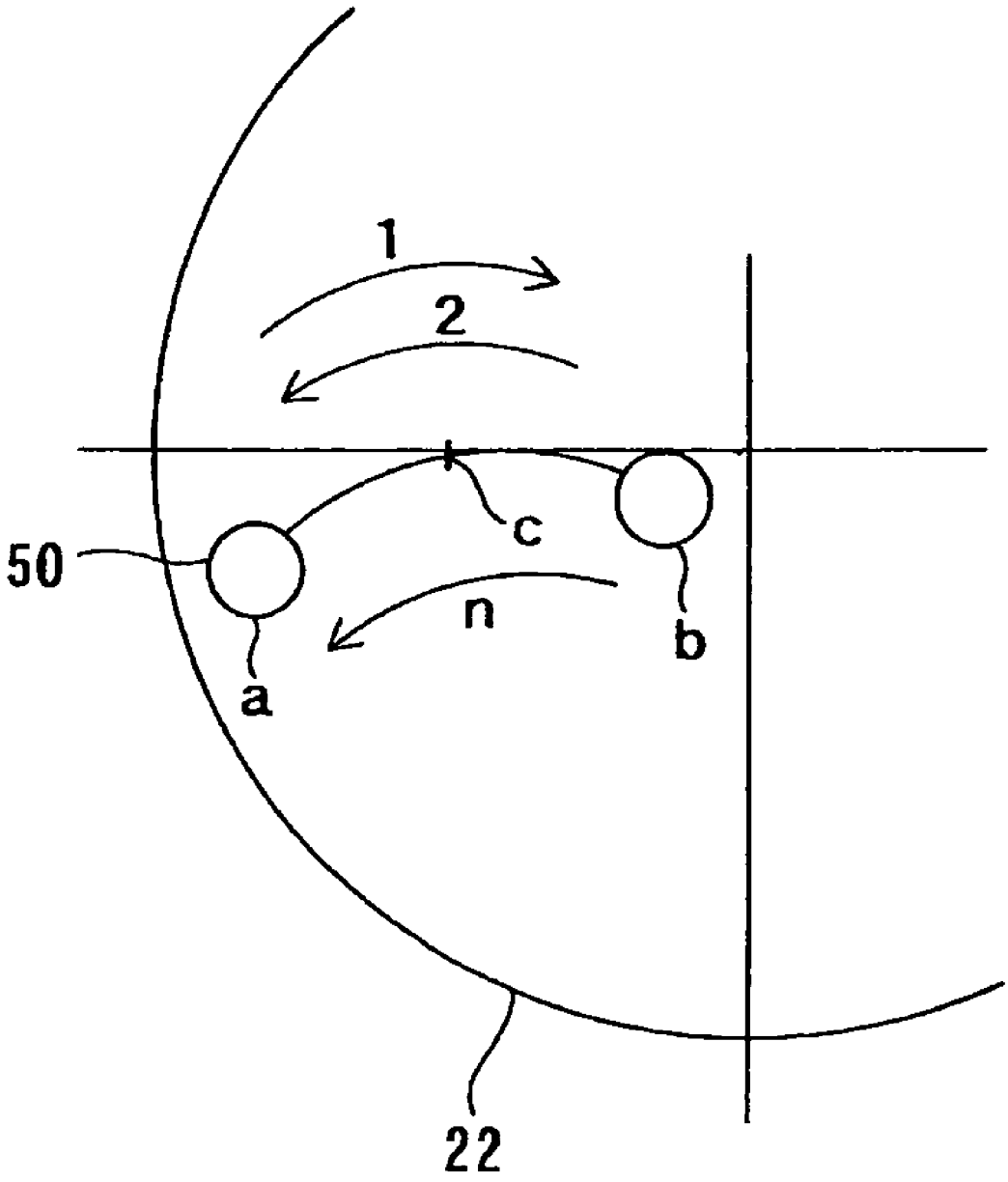
FIG. 20 is a schematic plan view showing a method for dressing the polishing pad by the dresser shown in FIG. 19.

FIG. 20 is a schematic plan view showing a method for dressing the polishing pad 22 by the dresser 50 shown in FIG. 19. The dresser 50 is swung (scanned) by the dresser swing motor 63 during dressing, and is thus moved on the polishing pad 22 while describing arcs as shown in FIG. 20. In FIG. 20, the loci of the dresser 50 are schematically shown in consideration of the rotation of the polishing table 12. For example, in the case where the dresser 50 performs dressing for one minute, after the dresser 50 dresses the polishing pad 22 to some extent, the vertical position of the dresser 50 is measured at final several times of scanning of the dresser 50 to obtain the latest pad information. For example, the vertical position (height) of the dresser 50, is measured at final six times of scanning of the dresser 50, and hence the amount of wear of the polishing pad 22 can be accurately measured.

As measuring position of the amount of wear of the polishing pad (the height of the polishing pad), the vertical position of the dresser 50 is measured by the displacement sensor 60 each time when the dresser 50 reaches the swing ends (the positions a, b in FIG. 20). The measured results of the vertical position of the dresser 50 at the swing ends (a, b) are averaged, for example, six times of the measured results are averaged, and the amount of wear of the polishing pad (vertical position of the polishing pad) 22 after polishing of the first semiconductor wafer is grasped. This amount of wear of the polishing pad is referred to as Data No. 1. The amount of wear of the polishing pad 22 may be judged in such a manner that the vertical position of the dresser 50 is measured each time when the dresser 50 passes through the swing center (the position c in FIG. 20) of locus of the dresser 50, and the measured results of six times of scanning are averaged.

Then, after polishing the second semiconductor wafer W, the measured results of the vertical position of the dresser 50 in final six times of scanning in the scan-dressing are averaged to obtain Data No. 2 in the same manner as the above. Thereafter, Data No. 3, Data No. 4, . . . Data No. n are obtained in the same manner as the above.

The plural data which are extracted from the sequential data of the amount of wear obtained by the above method are averaged. Therefore, an error occurring each time when dressing is performed can be eliminated and the amount of wear of the polishing pad can be accurately measured. Averaging of three sequential data is expressed as follows:

Data No. 3*R*=(Data No. 1+Data No. 2+Data No. 3)/3

Data No. 4*R*=(Data No. 2+Data No. 3+Data No. 4)/3

The number of data to be averaged may be suitably set. For example, three data or four data may be suitable.

The polishing apparatus 10 according to the present embodiment has a temperature sensor 70 for measuring the temperature of the top ring shaft 18. The temperature sensor 70 comprises a radiation temperature sensor, and is fixedly mounted on the upper surface of the top ring head 16 so as to face the top ring shaft 18.

Figure 2:
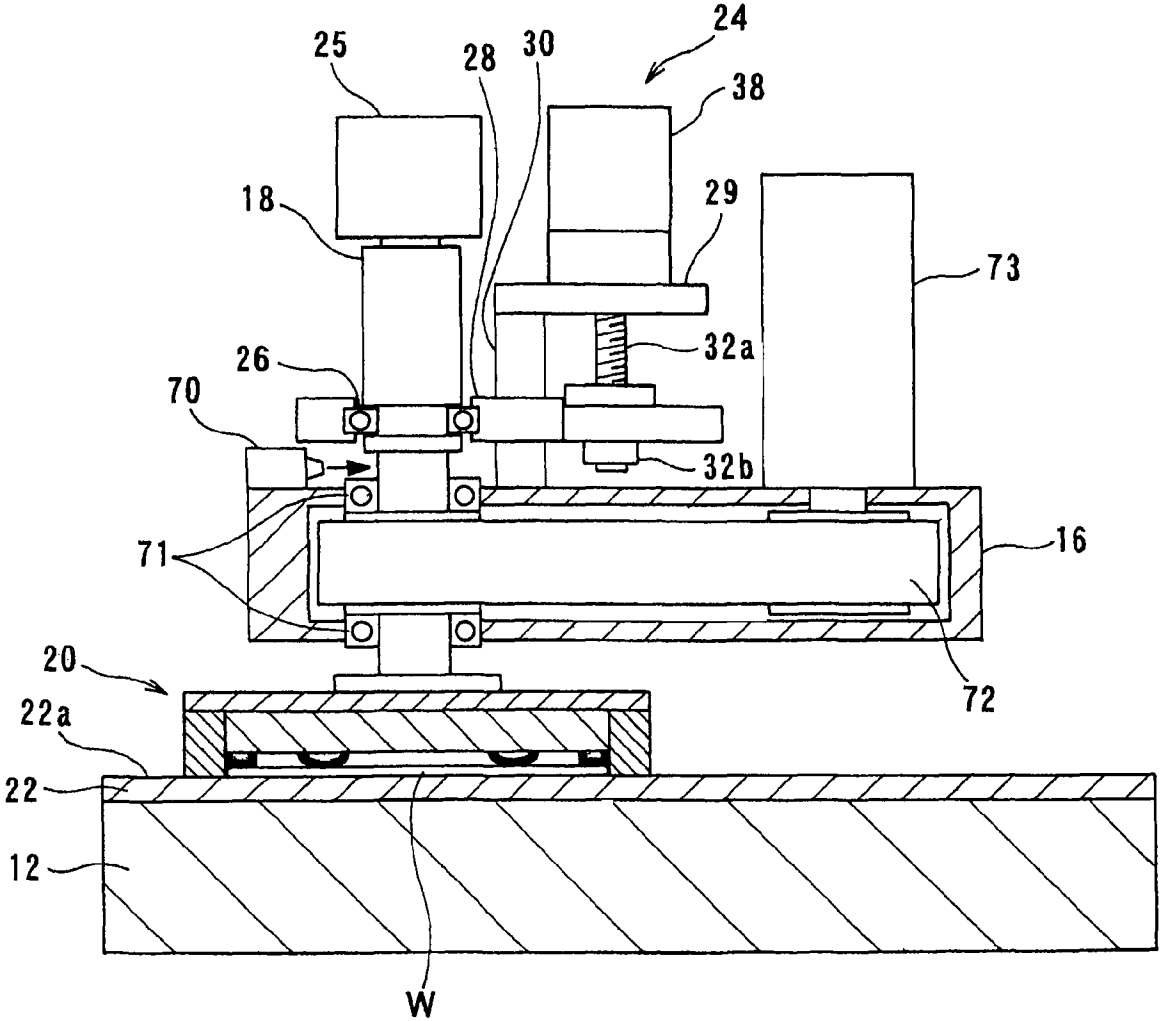
FIG. 2 is a schematic cross-sectional view showing a top ring shaft supporting a top ring, bearings for supporting the top ring shaft rotatably, a temperature sensor, and other components.

FIG. 2 schematically shows the top ring shaft 18 supporting the top ring 20, bearings 71 by which the top ring shaft 18 is rotatably supported, the temperature sensor 70, and other components. As shown in FIG. 2, the top ring shaft 18 is rotatably supported on the top ring head 16 by the bearings 71. The top ring shaft 18 is operatively coupled to a top ring rotating motor 73 by a timing belt 72. Therefore, the top ring shaft 18 is rotated when the top ring rotating motor 73 is energized. Since the top ring shaft 18 which supports the top ring 20 for holding the semiconductor wafer W is subjected to relatively large thrust forces while the semiconductor wafer W is being polished, the bearings 71 for rotatably supporting the top ring shaft 18 comprise bearings having a high load withstanding capability. When the bearings 71 are in operation, the bearings 71 produce heat by friction because they are mechanical components comprising rolling bodies such as balls or rollers for guiding rotation through rolling contact motion. Therefore, the top ring shaft 18 which is fixed to the inner races of the bearings 71 are vertically elongated due to a temperature rise, thus tending to displace the top ring 20 downwardly from a preset polishing position that represents a calculated and set vertical position for the top ring 20.

According to the present embodiment, while the polishing apparatus 10 is in operation, the temperature of the top ring shaft 18 is measured by the temperature sensor 70, and the measured value of the temperature of the top ring shaft 18 is inputted to a calculating unit (calculating device) in the controller 47. Based on the supplied temperature value, the calculating unit calculates the elongation ($\Delta L$) of the top ring shaft 18 due to the temperature rise. The controller 47 then corrects the preset polishing position of the top ring 20 which has been set, based on the calculated elongation ($\Delta L$) of the top ring shaft 18, and controls the top ring 20 to keep an optimum position at the time of polishing (described below in detail).

When the semiconductor wafer W is polished by the polishing apparatus 10 shown in FIGS. 1 and 2, the thickness of the polishing pad 22 varies at all times because the polishing pad 22 is progressively worn, dressed, and replaced. If the semiconductor wafer W is pressed by an inflated elastic membrane in the top ring 20, then the range in which the outer peripheral area of the semiconductor wafer W and the elastic membrane contact each other, and the surface pressure distribution over the outer peripheral area of the semiconductor wafer W change depending on the distance between the elastic membrane and the semiconductor wafer W. In order to prevent the surface pressure distribution over the semiconductor wafer W from changing as the polishing process progresses, it is necessary to keep the distance between the top ring 20 and the polishing surface of the polishing pad 22 constant at the time of polishing. For keeping the distance between the top ring 20 and the polishing surface of the polishing pad 22 constant, it is necessary to detect the vertical position of the polishing surface of the polishing pad 22 and adjust the lowered position of the top ring 20 after the polishing pad 22 is replaced and initially dressed by the dresser 50 as described later, for example. The process of detecting the vertical position of the polishing surface of the polishing pad 22 will be referred to as "pad search" by the top ring.

The pad search by the top ring is carried out by detecting the vertical position (height) of the top ring 20 when the lower surface of the top ring 20 or the lower surface of the semiconductor wafer W is brought into contact with the polishing surface of the polishing pad 22. Specifically, in the pad search by the top ring, the top ring 20 is lowered by the servomotor 38 while the number of revolutions of the servomotor 38 is being counted by an encoder combined with the servomotor 38. When the lower surface of the top ring 20 contacts the polishing surface of the polishing pad 22, the load on the servomotor 38 increases, and the current flowing through the servomotor 38 increases. The current flowing through the servomotor 38 is detected by a current detector in the controller 47. When the detected current becomes large, the controller 47 judges that the lower surface of the top ring 20 contacts the polishing surface of the polishing pad 22. At the same time, the controller 47 calculates the lowered distance (position) of the top ring 20 from the count (integration value) of the encoder, and stores the calculated lowered distance. The controller 47 then obtains the vertical position (height) of the polishing surface of the polishing pad 22 from the lowered distance of the top ring 20, and calculates a preset polishing position of the top ring 20 from the vertical position of the polishing surface of the polishing pad 22.

The semiconductor wafer W used in the pad search by the top ring should preferably be a dummy wafer for use in the pad search, rather than a product wafer. Although a product wafer may be used in the pad search, semiconductor devices on such product wafer may possibly be broken in the pad search. Using a dummy wafer in the pad search is effective to prevent semiconductor devices on such product wafer from being damaged or broken.

The servomotor 38 should preferably be a servomotor with a variable maximum current. In the pad search, the maximum current of the servomotor 38 may be adjusted to a value ranging from about 25% to 30% to prevent the semiconductor wafer (dummy wafer) W, the top ring 20, and the polishing pad 22 from being placed under an excessive load when the lower surface of the top ring 20 or the lower surface of the semiconductor wafer (dummy wafer) W is brought into contact with the polishing surface of the polishing pad 22. Since the time when the top ring 20 will contact the polishing pad 22 can approximately be predicted from the descending time or the descending distance of the top ring 20, the maximum current of the servomotor 38 should preferably be lowered before the top ring 20 contacts the polishing pad 22. In this manner, the top ring 20 can be lowered quickly and reliably.

Figure 21:
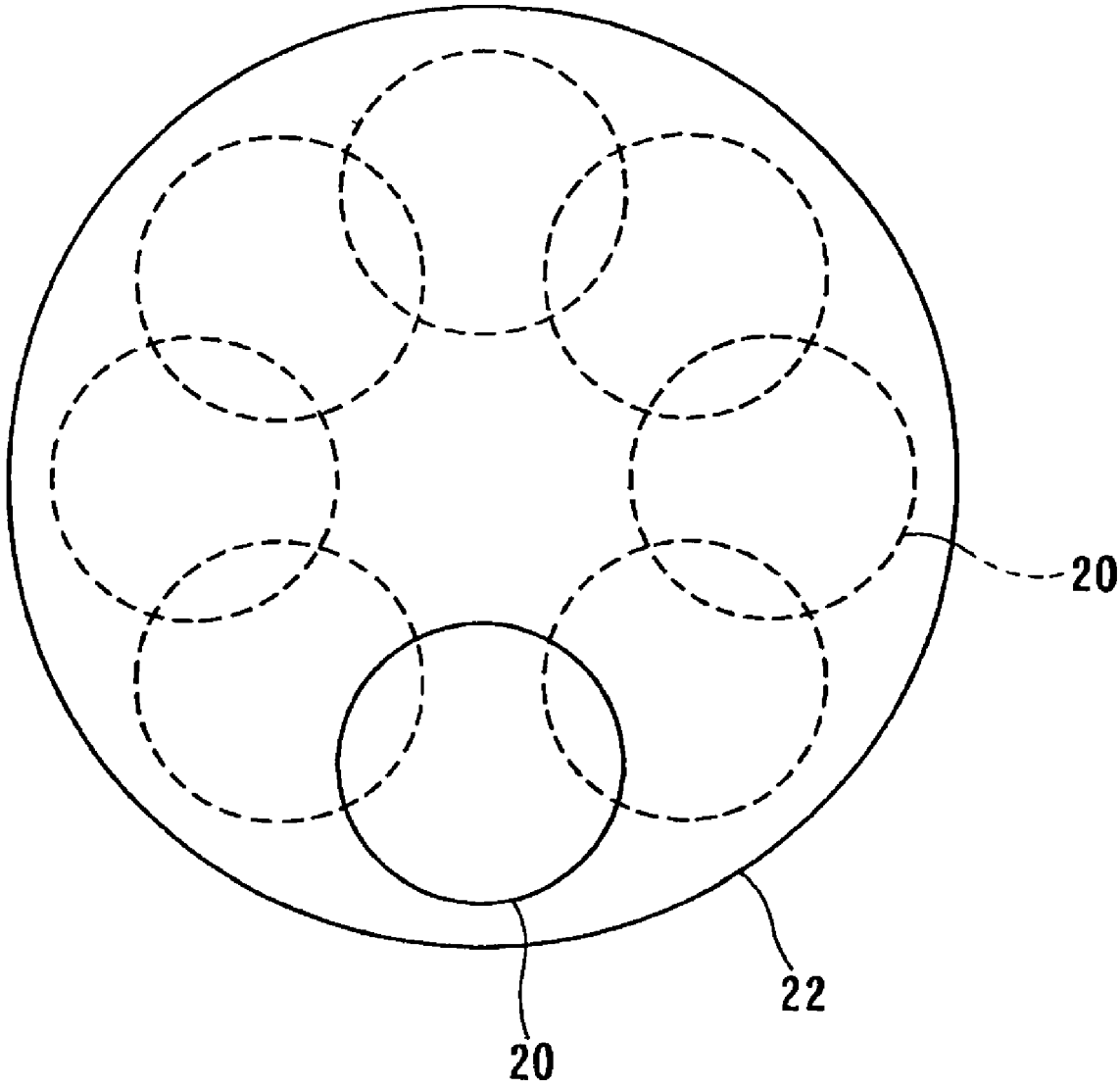
FIG. 21 is a schematic plan view showing contacting operation by the top ring at the plural different positions on the polishing pad.

In some cases, the polishing surface (surface of the polishing pad) 22*a* does not become completely flat due to undulation of the polishing pad 22, individual variability of attachment of the polishing pad 22, machining accuracy of the surface of the polishing table 12, or the like. In order to improve the accuracy of the pad search by the top ring, it is considered that contacting operation of bringing the top ring 20 into contact with the surface of the polishing pad 22 is performed at plural different positions on the polishing pad 22. FIG. 21 is a schematic plan view showing such contacting operation by the top ring 20 at the plural different positions on the polishing pad 22. As shown in FIG. 21, the pad search by the top ring 20 is performed at eight different positions on a concentric circle of the polishing pad 22, for example, and the data obtained at the eight different positions are averaged to grasp an initial vertical position of the polishing pad 22.

The pad search by the dresser 50 (described later) may be performed at plural different positions, and the measured results may be averaged.

Figure 3:
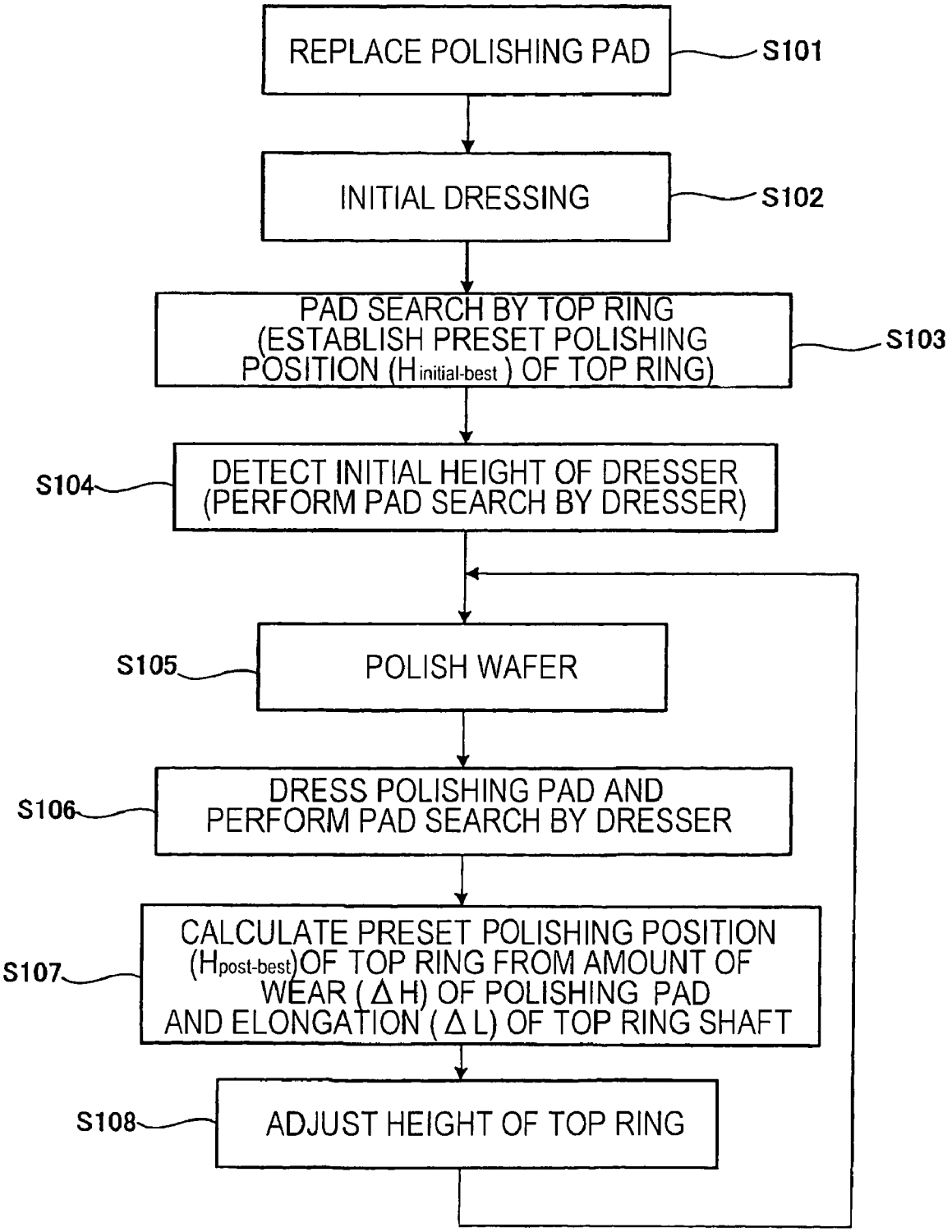
FIG. 3 is a flowchart of a polishing operation of the polishing apparatus according to an embodiment of the present invention.

A polishing operation of the polishing apparatus 10 shown in FIGS. 1 and 2 will be described below with reference to FIG. 3. FIG. 3 is a flowchart of the polishing operation of the polishing apparatus 10. As shown in FIG. 3, the polishing operation starts with the replacement of the polishing pad in step S101. Specifically, the polishing pad which has been worn is detached from the polishing table 12, and a brand-new polishing pad 22 is mounted on the polishing pad 12.

The brand-new polishing pad 22 has a low polishing capability because its polishing surface is not rough and has surface undulations due to the way in which the polishing pad 22 is mounted on the polishing table 12 or due to the individual configuration of the polishing pad 22. In order to correct such surface undulations to prepare the polishing pad 22 for polishing, it is necessary to dress the polishing pad 22 to roughen the polishing surface thereof for an increased polishing capability. The initial surface adjustment (dressing) is referred to as initial dressing (step S102).

Then, the pad search is performed by the top ring 20 using a dummy wafer for pad search in step S103. As described above, the pad search is a process for detecting the vertical position (height) of the surface of the polishing pad 22. The pad search is performed by detecting the vertical position (height) of the top ring 20 when the lower surface of the top ring 20 is brought into contact with the polishing surface of the polishing pad 22.

Specifically, in the pad search, the servomotor 38 is energized to lower the top ring 20 while the number of revolutions of the servomotor 38 is being counted by the encoder combined with the servomotor 38. When the lower surface of the top ring 20 contacts the polishing surface of the polishing pad 22, the load on the servomotor 38 increases, and the current flowing through the servomotor 38 increases. The current flowing through the servomotor 38 is detected by the current detector in the controller 47. When the detected current becomes large, the controller 47 judges that the lower surface of the top ring 20 contacts the polishing surface of the polishing pad 22. At the same time, the controller 47 calculates the lowered distance (position) of the top ring 20 from the count (integration value) of the encoder, and stores the calculated lowered distance. The controller 47 then obtains the vertical position of the polishing surface of the polishing pad 22 from the lowered distance of the top ring 20, and calculates the optimum position of the top ring 20 at the time of polishing from the vertical position of the polishing surface of the polishing pad 22. According to the present embodiment, in the pad search by the top ring 20, the temperature sensor 70 measures the temperature of the top ring shaft 18, and the controller 47 determines a shaft temperature $T_{initial}$.

Figures 4A, 4B:
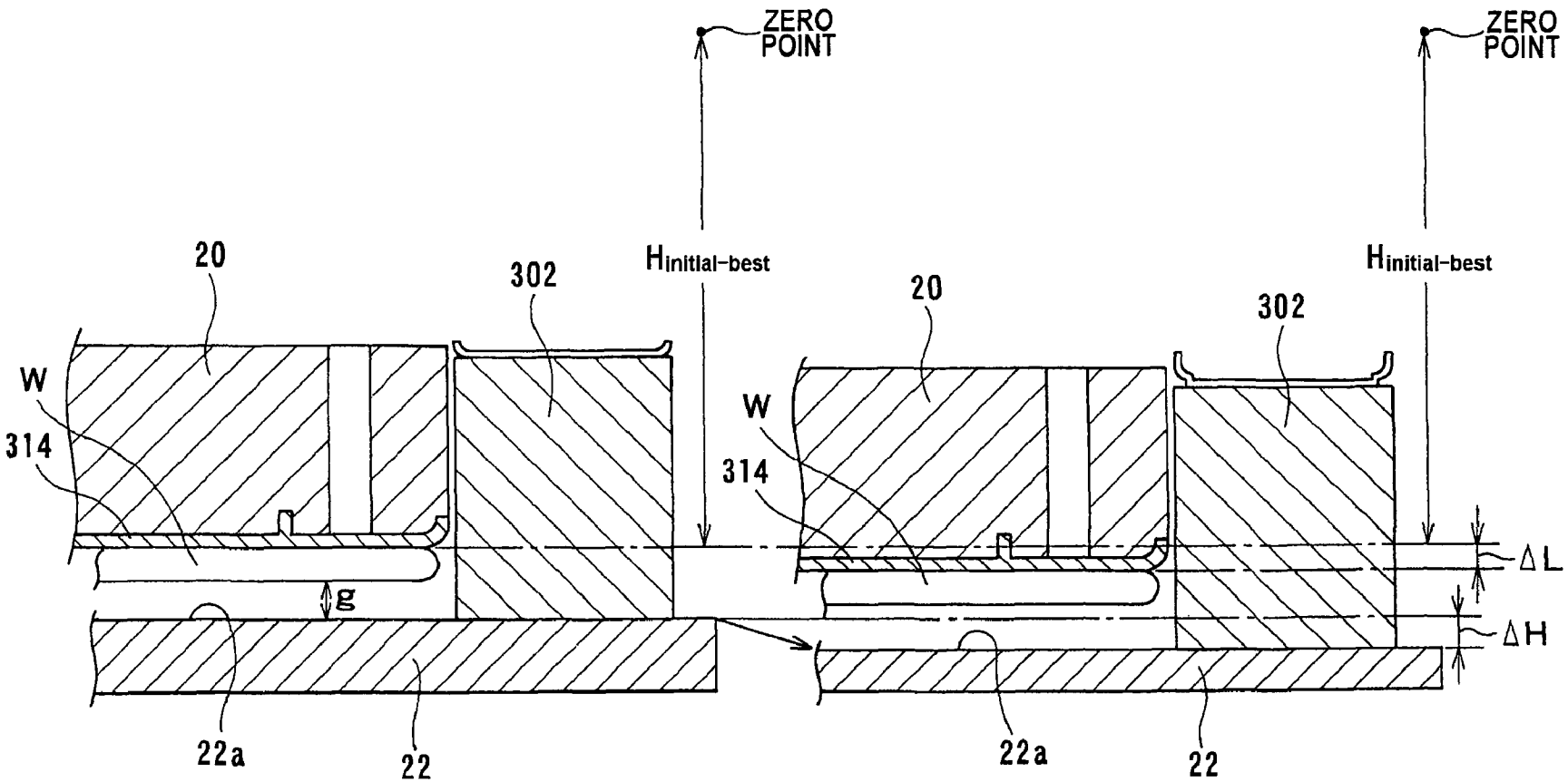
FIGS. 4A and 4B are schematic views showing a method for correcting a preset polishing position of the top ring at the time of polishing.

As shown in FIG. 4A, when the top ring 20 is in an optimum position at the time of polishing, the lower surface, i.e., the surface to be polished, of the semiconductor wafer W which is held as a product wafer by the top ring 20 is spaced from the polishing surface of the polishing pad 22 by a slight gap (g) of about 1 mm, for example. At this time, an elastic membrane 314 held against the upper surface of the semiconductor wafer W is not supplied with a pressurized fluid such as compressed air, and hence is not inflated. The semiconductor wafer W has its outer circumferential edge held by a retainer ring 302 disposed around the top ring 20.

The vertical position of the top ring 20 in which the lower surface, i.e., the surface to be polished, of the semiconductor wafer W held as a product wafer by the top ring 20 is not held in contact with the polishing surface of the polishing pad 22, but is spaced by the slight gap (g) from the polishing surface of the polishing pad 22, is set as a preset polishing position ($H_{initial\text{-}best}$) of the top ring 20 in the controller 47 (step S103). In FIG. 4A, the preset polishing position ($H_{initial\text{-}best}$) of the top ring 20 is represented as the distance from a reference position (zero point) which is the most lifted position of the top ring 20. The lower surface of the elastic membrane 314 is the basis of the preset polishing position ($H_{initial\text{-}best}$) of the top ring 20.

Then, a pad search by the dresser 50 is performed in step S104. The pad search by the dresser 50 is carried out by detecting the vertical position of the dresser 50 when the lower surface of the dresser 50 is brought into contact with the polishing surface of the polishing pad 22 under a predetermined pressure. Specifically, the air cylinder 53 is actuated to bring the dresser 50 into contact with the polishing surface 22*a* of the polishing pad 22 which has been initially dressed. The displacement sensor 60 detects the initial position (initial height) of the dresser 50, and the controller (processor) 47 stores the detected initial position (initial height) of the dresser 50. The initial dressing process in step S102 and the pad search by the dresser in step S104 may be carried out simultaneously. Specifically, the vertical position (initial position) of the dresser 50 may be detected finally in the initial dressing process, and the detected vertical position (initial height value) of the dresser 50 may be stored in the controller (processor) 47.

If the initial dressing process in step S102 and the pad search by the dresser in step S104 are carried out simultaneously, then they are followed by the pad search by the top ring in step S103.

Then, the top ring 20 receives and holds a semiconductor wafer W as a product wafer from a substrate transfer device (pusher). Thereafter, the top ring 20 is lowered to the preset polishing position ($H_{initial\text{-}best}$) which has been obtained in the pad search by the top ring in step S103. Before the semiconductor wafer W is polished, since the semiconductor wafer W is attracted to and held by the top ring 20, there is a small gap of about 1 mm, for example, between the lower surface (the surface to be polished) of the semiconductor wafer W and the polishing surface of the polishing pad 22. At this time, the polishing table 12 and the top ring 20 are being rotated about their own axes. Then, the elastic membrane 314 located at the upper surface of the semiconductor wafer W is inflated under the pressure of a fluid supplied thereto to press the lower surface of the semiconductor wafer W against the polishing surface of the polishing pad 22. As the polishing table 12 and the top ring 20 are being moved relatively to each other, the lower surface of the semiconductor wafer W is polished to a predetermined state, e.g., a predetermined film thickness, in step S105.

When the polishing of the lower surface of the semiconductor wafer W is finished in step S105, the top ring 20 transfers the polished semiconductor wafer W to the substrate transfer device (pusher), and receives a new semiconductor wafer W to be polished from the substrate transfer device. While the top ring 20 is replacing the polished semiconductor wafer W with the new semiconductor wafer W, the dresser 50 dresses the polishing pad 22 in step S106.

The polishing surface 22*a* of the polishing pad 22 is dressed as follows: The air cylinder 53 presses the dresser 50 against the polishing surface 22*a*, and at the same time a pure water supply nozzle (not shown) supplies pure water to the polishing surface 22*a*. In this state, the dresser 50 rotates around the dresser shaft 51 to bring the lower surface (diamond particles) of the dressing member 50*a* into sliding contact with the polishing surface 22*a*. The dresser 50 scrapes off a surface layer of the polishing pad 22 by dressing.

After the polishing surface 22*a* is dressed, the pad search by the dresser 50 is performed in step S106. The pad search by the dresser 50 is carried out in the same manner as with step S104. Alternatively, the pad search by the dresser 50 may be performed finally in the dressing process, so that the pad search by the dresser 50 and the dressing process can be carried out simultaneously. In step S106, the dresser 50 and the polishing table 12 should be rotated at the same speeds, and the dresser 50 may be loaded under the same conditions, as with step S104. According to the pad search by the dresser 50, the vertical position of the dresser 50 after dressing is detected in step S106.

Then, the controller 47 determines the difference between the initial position (initial height value) of the dresser 50 determined in step S104 and the vertical position of the dresser 50 determined in step S106, thereby determining an amount of wear (ΔH) of the polishing pad 22. At the same time, the temperature sensor 70 measures a temperature of the top ring shaft 18 to determine a shaft temperature $T_{post}$. The controller 47 subtracts the shaft temperature $T_{initial}$ determined in the pad search from the shaft temperature $T_{post}$, thereby determining a shaft temperature change (ΔT) after the pad search according to the equation (1) shown below. Then, the controller 47 calculates an elongation (ΔL) of the top ring shaft 18 from the shaft temperature change (ΔT) according to the equation (2) shown below. The temperature sensor 70 detects the temperature of the top ring shaft 18 while the top ring 20 is being lifted at the position of the substrate transfer device (pusher), for example. The shaft temperature change (ΔT) and the elongation (ΔL) of the top ring shaft 18 are calculated by a calculator (calculating device) of the controller 47.

$$\Delta T = T_{post} - T_{initial} \quad (1)$$

($T_{post}$: the shaft temperature which has been changed)

$$\Delta L = \alpha \cdot L_{initial} \cdot \Delta T \quad (2)$$

(α: coefficient of linear expansion, $L_{initial}$: original length of the shaft)

The controller 47 then calculates a preset polishing position ($H_{post\text{-}best}$) of the top ring 20 for polishing a next semiconductor wafer W according to the following equation (3) based on the amount of wear (ΔH) of the polishing pad 22, the elongation (ΔL) of the top ring shaft 18, and the preset polishing position ($H_{initial\text{-}best}$) of the top ring 20, which has been determined in the pad search in step S103, in step S107:

$$H_{post\text{-}best} = H_{initial\text{-}best} + \Delta H - \Delta L \quad (3)$$

Specifically, as shown in FIG. 4B, the amount of wear (ΔH) of the polishing pad 22 and the elongation (ΔL) of the top ring shaft 18, which are factors that affect the vertical position of the top ring 20 during the polishing process, are detected, and the preset polishing position ($H_{initial\text{-}best}$) of the top ring 20 which has been set is corrected based on the amount of wear (ΔH) of the polishing pad 22 and the elongation (ΔL) of the top ring shaft 18 which have been detected, thereby determining a preset polishing position ($H_{post\text{-}best}$) of the top ring 20 for polishing a next semiconductor wafer W. In this manner, the top ring 20 is controlled so as to take an optimum vertical position in the polishing process.

Next, the servomotor 38 is energized to lower the top ring 20 which is holding the semiconductor wafer W to the preset polishing position ($H_{post\text{-}best}$) determined in step S107, thereby adjusting the height of the top ring 20 in step S108. Thereafter, steps S105 through S108 are repeated until the polishing pad 22 is worn out to polish a number of semiconductor wafers W. Thereafter, the polishing pad 22 is replaced in step S101. In step S107, the elongation (ΔL) of the top ring shaft 18 is calculated according to the equations (1) and (2). However, the elongation of the top ring shaft 18 may be set to either one of fixed values $\Delta L_1$ through $\Delta L_8$, shown below, depending on the change ΔT in the shaft temperature.

When $\Delta T \leqq -20°$ C., the elongation of the top ring shaft 18 is set to $\Delta L_1$. When $-20°$ C.$<\Delta T \leqq -15°$ C., the elongation of the top ring shaft 18 is set to $\Delta L_2$. When $-15°$ C.$\leqq \Delta T \leqq -10°$ C., the elongation of the top ring shaft 18 is set to $\Delta L_3$. When $-10°$ C.$<\Delta T \leqq -5°$ C., the elongation of the top ring shaft 18 is set to $\Delta L_4$. When 5° C.$\leqq \Delta T <10°$ C., the elongation of the top ring shaft 18 is set to $\Delta L_5$. When 10° C.$\leqq \Delta T <15°$ C., the elongation of the top ring shaft 18 is set to $\Delta L_6$. When 15° C.$\leqq \Delta T <20°$ C., the elongation of the top ring shaft 18 is set to $\Delta L_7$. When 20° C.$\leqq \Delta T$, the elongation of the top ring shaft 18 is set to $\Delta L_8$. The equation (3) in step S107 may be rewritten as follows:

$$H_{post\text{-}best} = H_{initial\text{-}best} + \Delta H - (\Delta L_1 \text{ through } \Delta L_8)$$

When $-5°$ C.$<\Delta T<5°$ C., the elongation of the top ring shaft 18 does not need to be corrected because any elongation and contraction of the top ring shaft 18 is negligibly small.

As described above with reference to the flowchart shown in FIG. 3, while the polishing apparatus 10 is in operation, the amount of wear (ΔH) of the polishing pad 22 and the elongation (ΔL) of the top ring shaft 18, which are factors that affect the vertical position of the top ring 20 at the time of polishing, are detected, and the preset polishing position ($H_{initial\text{-}best}$) of the top ring 20 which has been set is corrected based on the amount of wear (ΔH) of the polishing pad 22 and the elongation (ΔL) of the top ring shaft 18 which have been detected, thereby determining a preset polishing position ($H_{post\text{-}best}$) of the top ring 20 for polishing a next semiconductor wafer W. In this manner, the top ring 20 is controlled so as to take an optimum vertical position in the polishing process. Therefore, the pad search by the top ring for directly obtaining the preset polishing position of the top ring 20 at the time of polishing should be performed only when the polishing pad 22 is replaced, resulting in a greatly increased throughput.

In FIGS. 4A and 4B, the reference position (zero point) representing the preset polishing position ($H_{initial\text{-}best}$) is the most lifted position of the top ring 20. However, the reference position (zero point) representing the preset polishing position ($H_{initial\text{-}best}$) may be the vertical position of the polishing surface 22*a*. In this case, the preset polishing position ($H_{initial\text{-}best}$) is equal to the distance from the polishing surface 22*a* to the elastic membrane 314, and the equation (3) for determining the preset polishing position ($H_{post\text{-}best}$) of the top ring 20 remains the same.

Figure 5:
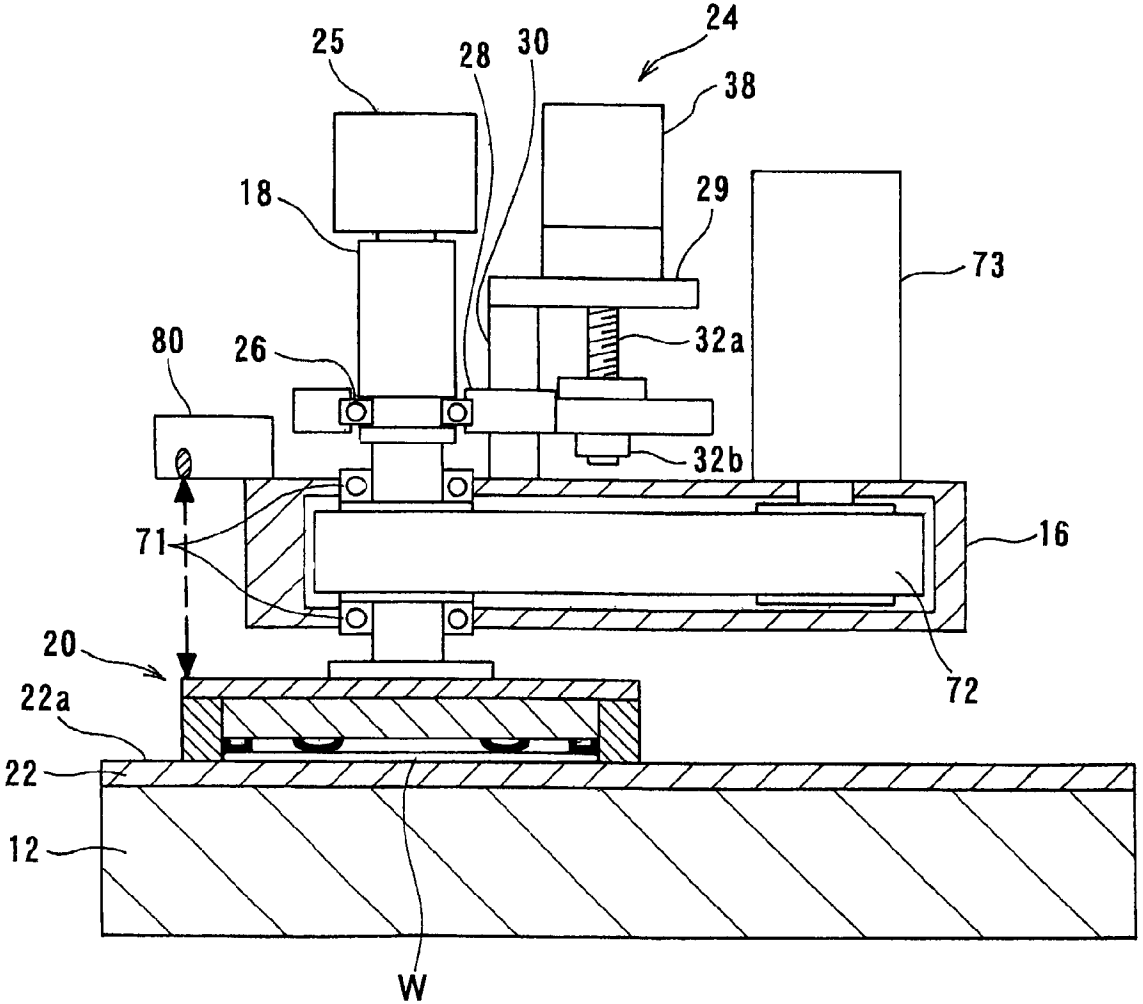
FIG. 5 is a schematic view showing a polishing apparatus which incorporates a non-contact distance sensor for directly measuring an elongation of the top ring shaft according to an embodiment of the present invention.

FIG. 5 is a schematic view showing a polishing apparatus according to another embodiment which incorporates a non-contact distance sensor 80 for directly measuring the elongation of the top ring shaft 18. As shown in FIG. 5, the non-contact distance sensor 80 is fixedly mounted on the upper surface of the top ring head 16. The non-contact distance sensor 80 is fixedly mounted on the upper surface of the top ring head 16 because the vertical position of the top ring head 16 can be regarded as a fixed vertical position which is not affected by temperature changes. The non-contact distance sensor 80 comprises a laser beam sensor, an ultrasonic sensor, or the like for measuring the distance from the distance sensor 80 to the upper surface of the top ring 20.

According to the polishing apparatus shown in FIG. 5, when the top ring 20 is in the preset polishing position ($H_{initial\text{-}best}$) at the time of the pad search by the top ring 20 in step S103, the distance sensor 80 measures the distance ($L_{initial}$) from the distance sensor 80 to the upper surface of the top ring 20. Then, instead of detecting the temperature of the top ring shaft in step S107, the distance sensor 80 measures the distance ($L_{post}$) from the distance sensor 80 to the upper surface of the top ring 20. The controller 47 subtracts the measured distance ($L_{initial}$) determined in the pad search by the top ring from the measured distance ($L_{post}$), thereby determining an elongation ($\Delta L$) of the top ring shaft 18 due to a temperature rise after the pad search according to the following equation (4).

$$\Delta L = L_{post} - L_{initial} \quad (4)$$

Thereafter, the controller 47 calculates a preset polishing position ($H_{post\text{-}best}$) of the top ring 20 for polishing a next semiconductor wafer W in the same manner as with step S107. The polishing apparatus shown in FIG. 5 also performs the same processing as with steps S101, S102, S104, S105, S106, S108.

According to the embodiment shown in FIG. 5, since the elongation ($\Delta L$) of the top ring shaft 18 due to the temperature rise can directly be detected by the distance sensor 80, the preset polishing position ($H_{post\text{-}best}$) of the top ring 20 at the time of polishing can accurately be controlled.

Figure 6B:
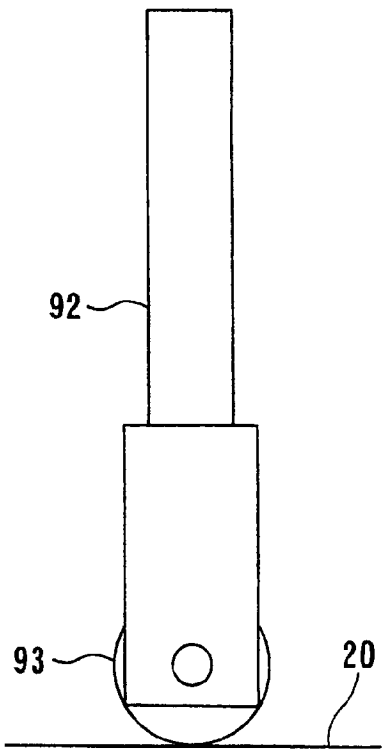
FIG. 6B is a schematic view showing a contact of the distance sensor.
Figure 6A:
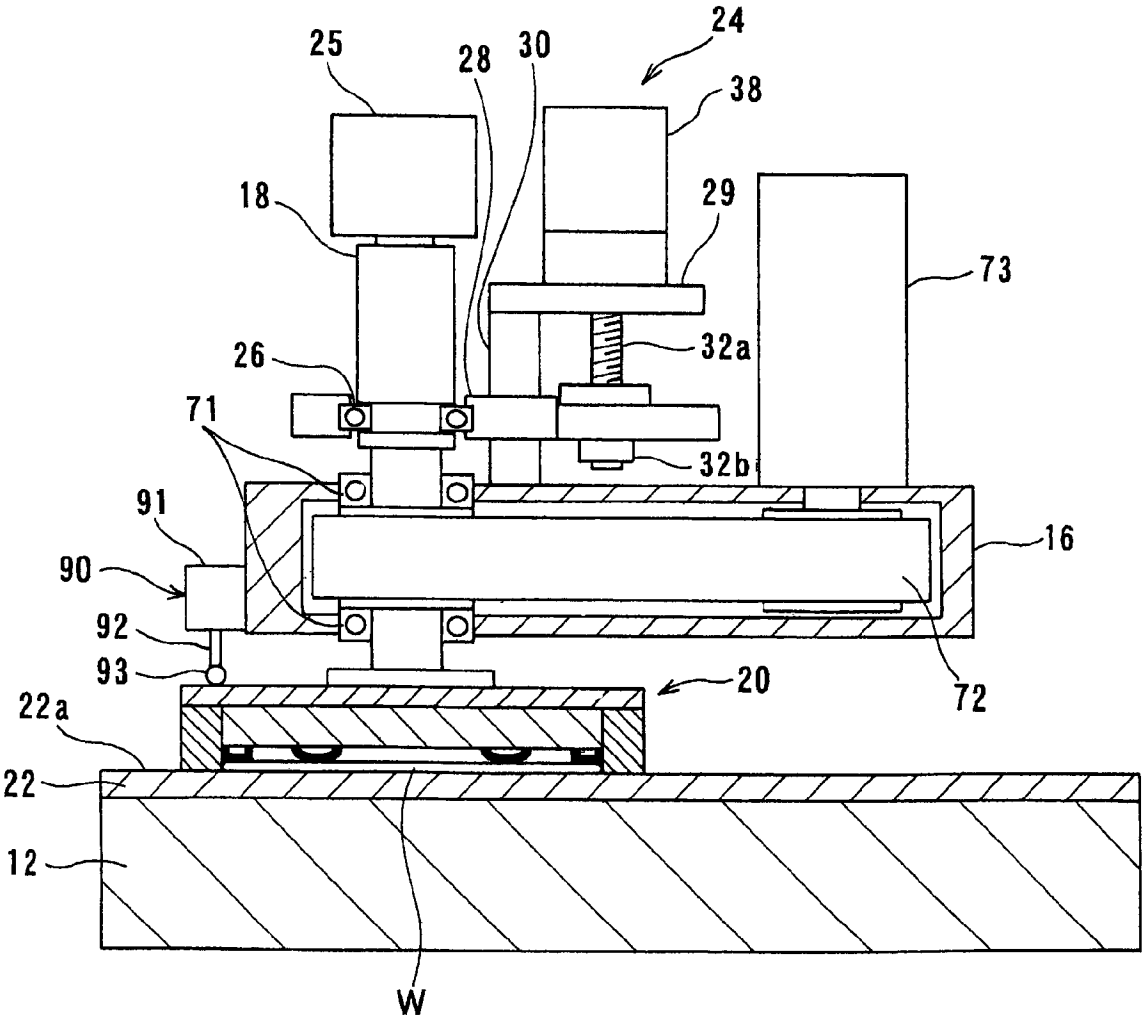
FIG. 6A is a schematic view showing a top ring shaft supporting a top ring, a top ring head, a distance sensor, and other components.

FIGS. 6A and 6B schematically show a polishing apparatus according to still another embodiment which incorporates a contact distance sensor 90 for directly measuring the elongation of the top ring shaft 18. FIG. 6A schematically shows the top ring shaft 18 which supports the top ring 20, the top ring head 16, the contact distance sensor 90, and other components. FIG. 6B schematically shows a contact of the distance sensor 90. As shown in FIGS. 6A and 6B, the contact distance sensor 90 is fixedly mounted on a side surface of the top ring head 16. The contact distance sensor 90 comprises a linear scale sensor, an eddy-current sensor, or the like. The contact distance sensor 90 includes a main sensor body 91, a contact rod 92 extending downwardly from the main sensor body 91, and a contact 93 in the form of a roller mounted on the lower distal end of the contact rod 92. With the contact 93 being held against the upper surface of the top ring 20, the distance sensor 90 measures the distance from the main sensor body 91 to the upper surface of the top ring 20. The polishing apparatus having the distance sensor 90 shown in FIGS. 6A and 6B operates in the same manner as the polishing apparatus shown in FIG. 5. The distance sensor 90 shown in FIGS. 6A and 6B has the contact 93 in the form of a roller because the contact 93 contacts the top ring 20 which rotates about its own axis. If the contact rod 92 has such a structure that the contact rod 92 is normally retracted upwardly and extends downwardly into contact with the upper surface of the top ring 20 only when the distance sensor 90 measures the distance, then the contact 93 may be dispensed with a roller because the contact rod 92 does not need to contact the upper surface of the top ring 20 while the top ring 20 is being rotated.

Figure 7B:
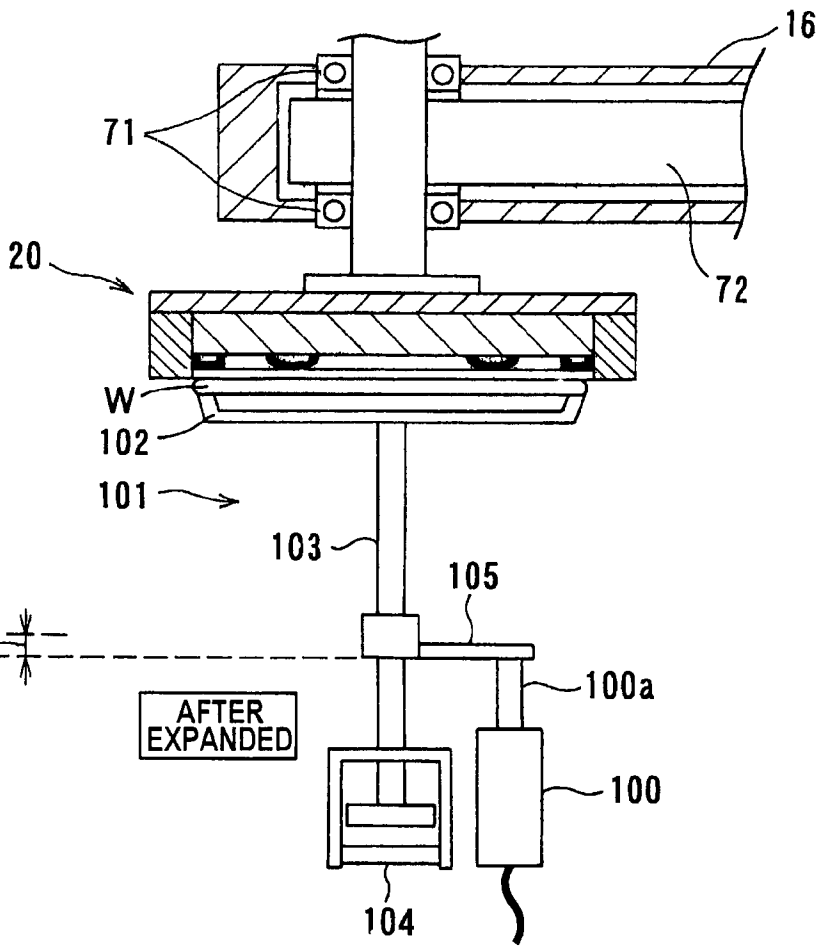
FIGS. 7A and 7B are schematic views showing a polishing apparatus which incorporates a contact distance sensor provided in a substrate transfer device (pusher) for measuring an elongation of a top ring shaft.
Figure 7A:
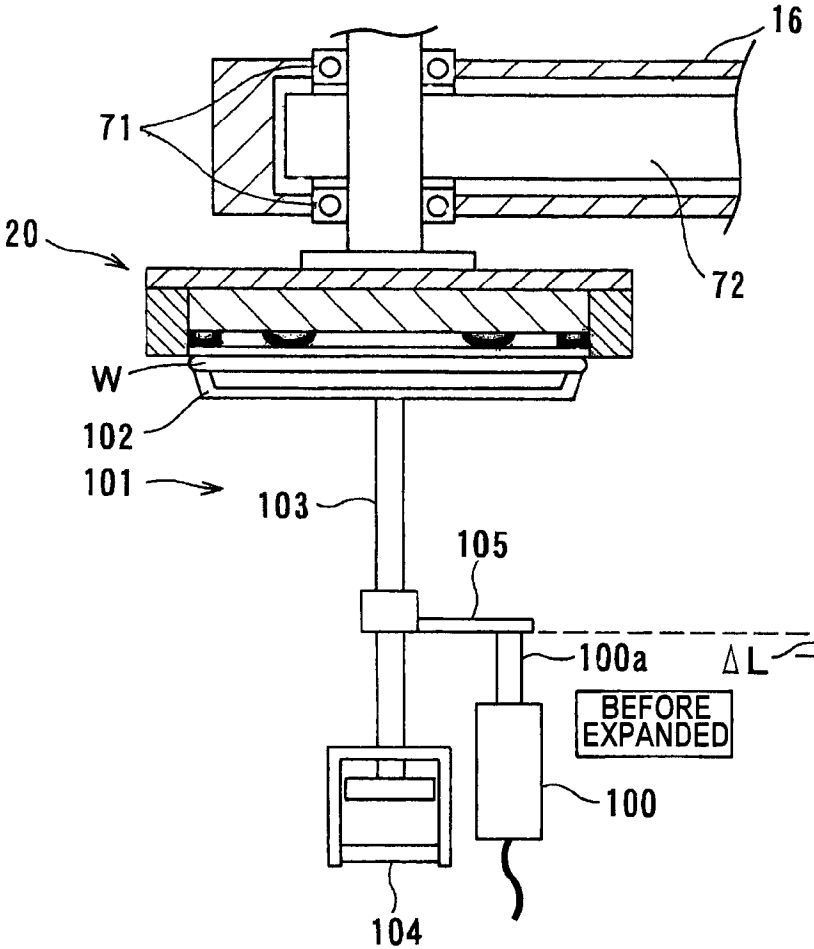

FIGS. 7A and 7B show a polishing apparatus according to still another embodiment which incorporates a contact distance sensor 100 for measuring the elongation of the top ring shaft 18, the contact distance sensor 100 being combined with a substrate transfer device (pusher). FIG. 7A shows the parts of the apparatus before the top ring shaft 18 is expanded, and FIG. 7B shows the parts of the apparatus after the top ring shaft 18 is expanded. As shown in FIGS. 7A and 7B, a pusher 101 comprises a pusher arm 102 for placing a semiconductor wafer W thereon, a pusher shaft 103 for lifting and lowering the pusher arm 102, and a wafer pressing cylinder 104 for lifting and lowering the pusher shaft 103 and pressing the semiconductor wafer W against the top ring 20. A measurement arm 105 is fixed to the pusher shaft 103. The contact distance sensor 100 is disposed adjacent to the wafer pressing cylinder 104 and has a contact rod 100*a* which is brought into contact with the measurement arm 105 for detecting the vertical position of the pusher shaft 103.

As shown in FIG. 7A, when the pusher 101 transfers a dummy wafer W to the top ring 20 for the pad search by the top ring 20 in step S103, the contact distance sensor 100 detects the vertical position of the pusher shaft 103. When the dummy wafer W is transferred from the pusher 101 to the top ring 20, the top ring 20, the dummy wafer W, and the pusher arm 102 are brought in contact with each other, with the top ring 20 being in the lowered position and the pusher shaft 103 being in the lifted position. Therefore, the contact distance sensor 100 detects the vertical position of the top ring 20 by detecting the vertical position of the pusher shaft 103. At this time, since the top ring shaft 18 is not elongated due to a temperature rise, the contact distance sensor 100 indirectly measures the initial length ($L_{initial}$) of the top ring shaft 18.

Then, as shown in FIG. 7B, when a semiconductor wafer W as a product wafer is transferred to the top ring 20, the top ring 20, the dummy wafer W, and the pusher arm 102 are brought in contact with each other, with the top ring 20 being in the lowered position and the pusher shaft 103 being in the lifted position. Therefore, the contact distance sensor 100 detects the vertical position of the top ring 20 by detecting the vertical position of the pusher shaft 103. At this time, since the top ring shaft 18 is elongated due to a temperature rise, the contact distance sensor 100 indirectly measures the length ($L_{post}$) of the top ring shaft 18 after the top ring shaft 18 is thermally expanded. The controller 47 subtracts the measured distance ($L_{initial}$) determined in the pad search from the measured distance ($L_{post}$), thereby determining an elongation ($\Delta L$) of the top ring shaft 18 due to the temperature rise after the pad search. Thereafter, the controller 47 calculates a preset polishing position ($H_{post\text{-}best}$) of the top ring 20 for polishing a next semiconductor wafer W according to the equation (3) in the same manner as with step S107. The polishing apparatus shown in FIGS. 7A and 7B also performs the same processing as with steps S101, S102, S104, S105, S106, S108.

The polishing apparatus shown in FIGS. 7A and 7B incorporates the contact distance sensor 100. However, the polishing apparatus may incorporate a non-contact distance sensor which may be disposed near the substrate transfer device (pusher) for detecting the position of the pusher arm 102 at the time of transferring the substrate.

Figures 22A, 22B, 22C:
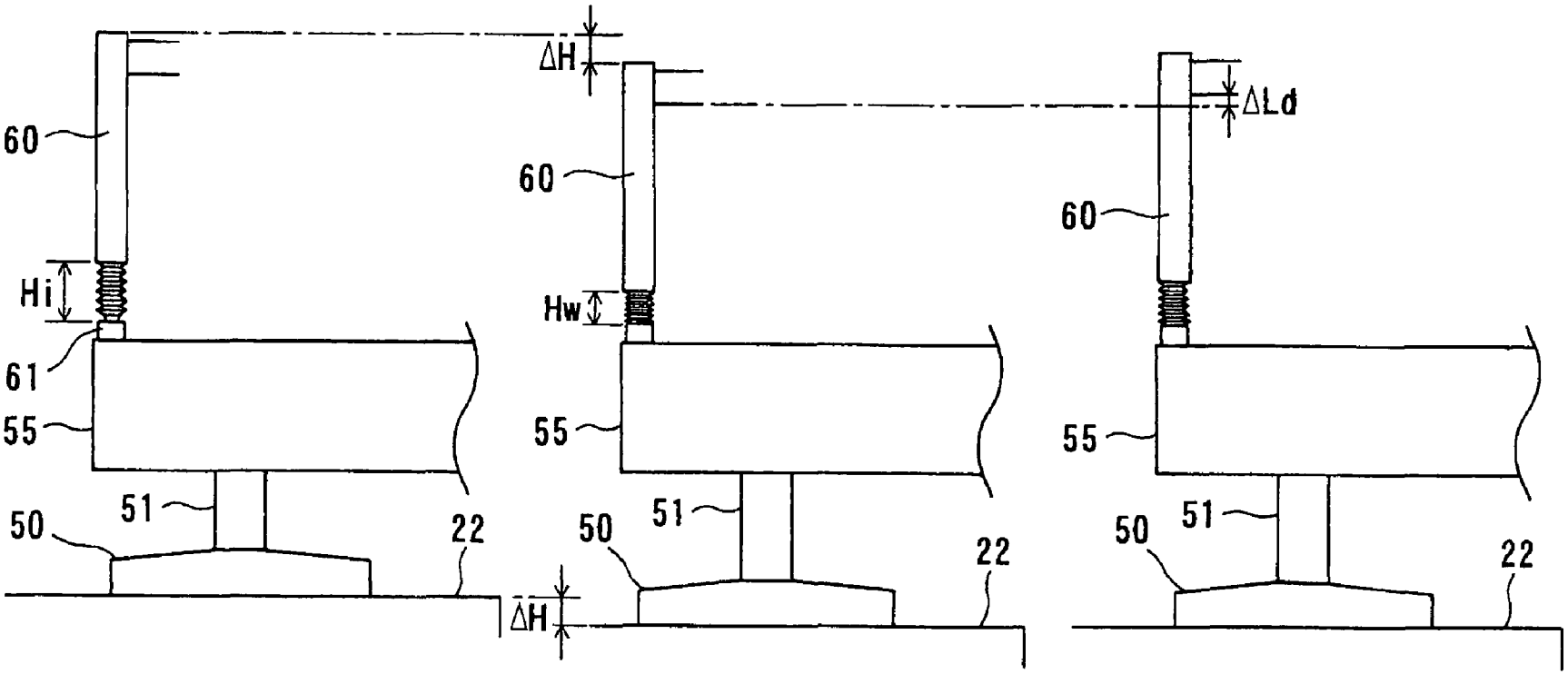
FIGS. 22A, 22B and 22C are schematic views showing the case where the elongation of the dresser shaft is considered when the amount of wear of the polishing pad is measured using the dresser.

In the embodiments shown in FIGS. 1 through 7, the preset polishing position of the top ring is corrected on the basis of the elongation of the top ring shaft. When the amount of wear of the polishing pad by the dresser 50 is measured, the elongation of the dresser shaft may be considered. FIGS. 22A, 22B and 22C are schematic views showing the case where the elongation of the dresser shaft is considered when the amount of wear of the polishing pad is measured using the dresser 50.

The calculation or detection of the elongation of the dresser shaft 51 may be performed in the same manner as with the calculation or detection of the elongation of the top ring shaft.

The temperature change ΔTd is expressed as follows:

$$\Delta Td = Td_{post-} - Td_{initial}$$

($Td_{post}$: the dresser shaft temperature which has been changed)

The elongation of the dresser shaft ΔLd is expressed as follows:

$$\Delta Ld = \beta \cdot Ld_{initial} \cdot \Delta Td$$

(β: coefficient of linear expansion, $Ld_{initial}$: original length of the dresser shaft)

The amount of wear of the polishing pad ΔH is expressed as follows:

$$\Delta H = Hi - Hw - \Delta Ld$$

(Hi: the distance between the displacement sensor 60 and the target plate 61 at the initial pad, Hw: the distance between the displacement sensor 60 and the target plate 61 after wear of the polishing pad)

The detection of the elongation of the dresser shaft may be performed by the contact distance sensor comprising a linear scale sensor, an eddy-current sensor, or the like, other than the temperature sensor, in the same manner as the top ring shaft.

According to the embodiments shown in FIGS. 1 through 7A and 7B, the amount of wear (ΔH) of the polishing pad 22 and the elongation (ΔL) of the top ring shaft 18, which are factors that affect the vertical position of the top ring 20 at the time of polishing, are detected, and the preset polishing position ($H_{initial\text{-}best}$) of the top ring 20 is corrected based on the amount of wear (ΔH) of the polishing pad 22 and the elongation (ΔL) of the top ring shaft 18 which have been detected, thereby determining a preset polishing position ($H_{post\text{-}best}$) of the top ring 20 for polishing a next semiconductor wafer W. In this manner, the top ring 20 is controlled so as to take an optimum vertical position at all times in the polishing process.

Figure 8:
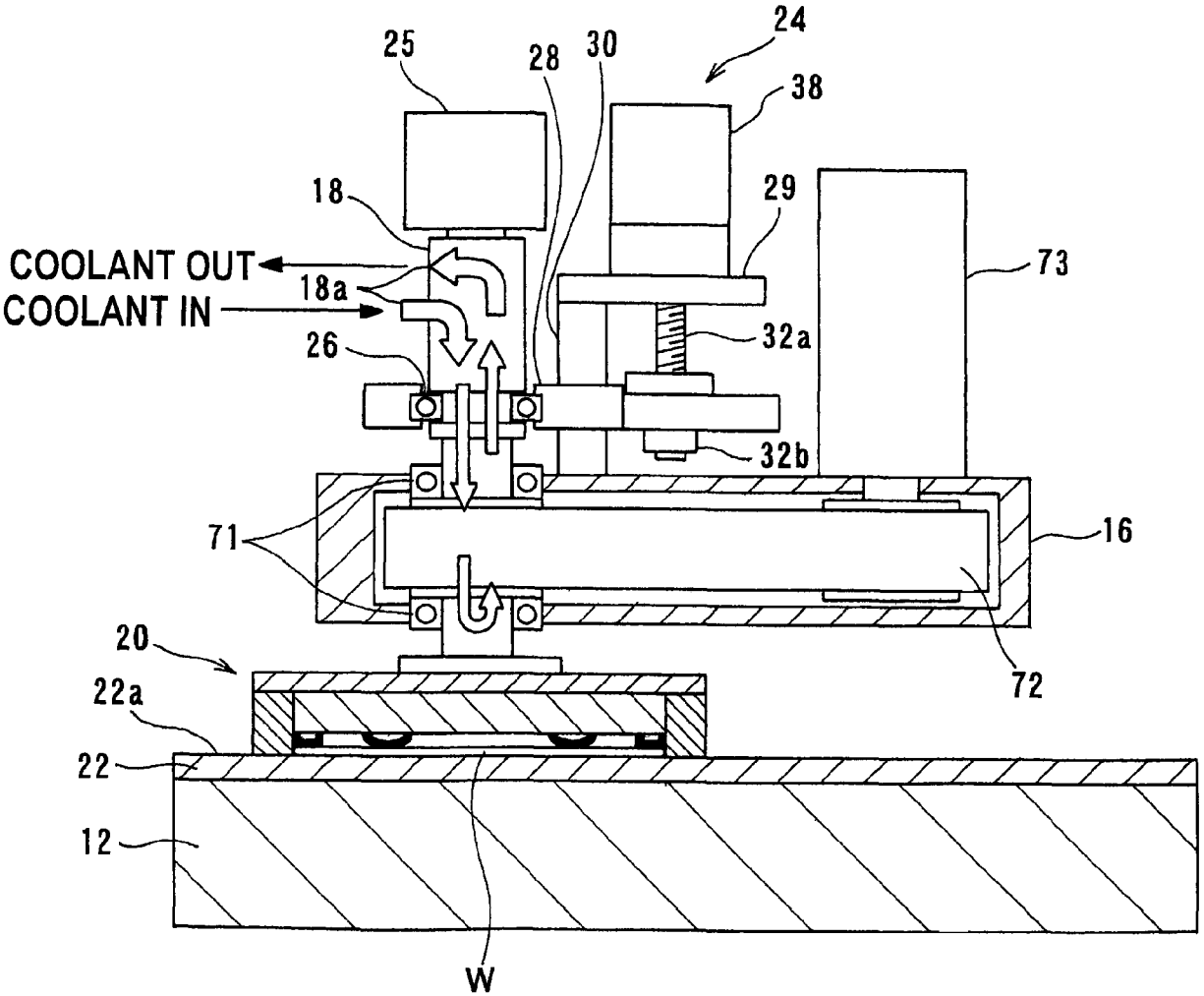
FIG. 8 is a cross-sectional view showing a cooling mechanism for cooling the top ring shaft.

FIG. 8 shows another embodiment in which the top ring shaft is cooled and is thus prevented from being thermally expanded while the polishing apparatus is in operation.

As shown in FIG. 8, the top ring shaft 18 has a coolant passage 18*a* defined therein. While the polishing apparatus is in operation, a coolant having a predetermined temperature flows through the coolant passage 18*a* to prevent the temperature of the top ring shaft 18 from rising. The polishing apparatus shown in FIG. 8 may operate according to the same sequence as shown in FIG. 3 except that the elongation (ΔL) of the top ring shaft 18 is set to ΔL=0 in step S107. Therefore, the equation (3) in step S107 is rewritten as follows:

$$H_{post\text{-}best} = H_{initial\text{-}best} + \Delta H$$

Next, a process for calculating a preset polishing position ($H_{post\text{-}best}$) of the top ring 20 after the amount of wear (ΔH) of the polishing pad 22 determined in step S107 of the flowchart in FIG. 3 is adjusted will be described below.

If the polishing pad 22 comprises a single-layer pad, then the amount of wear (ΔH) of the polishing pad 22 determined in step S107 may directly be put into the equation (3) to calculate a preset polishing position ($H_{post\text{-}best}$) of the top ring 20. However, if the polishing pad 22 comprises a multilayer pad such as a dual-layer pad comprising an upper IC layer (hard layer) and a lower SUBA layer (soft layer), then as the upper IC layer is progressively worn and thinned, the lower SUBA layer becomes more influential, resulting in a rebound (swell) in the portion of the polishing pad 22 which is positioned slightly inwardly of the portion of the polishing pad 22 that is pressed by the retainer ring. In FIGS. 4A and 4B, the retainer ring is represented by reference numeral 302.

The overall flexibility of the multilayer pad is provided by the total of the upper IC layer and the lower SUBA layer. As the multilayer pad is worn, the upper IC layer is thinned. Since the lower SUBA layer is softer than the upper IC layer, when the upper IC layer is thinned, the portion of the polishing pad which is located slightly inwardly of the retainer ring is rebounded largely. The profile control over the edge of the semiconductor wafer W is performed by utilizing the rebound of the polishing pad. Therefore, in order to ensure an optimum edge profile against the wear of the polishing pad, the top ring may be lifted by a distance that is commensurate with the rebound in the polishing pad to release the semiconductor wafer W accordingly. Specifically, the amount of wear (ΔH) of the polishing pad 22 which is determined in step S107 is multiplied by an adjustment coefficient (C) in the range of $0 \leqq C < 1$ or $1 < C \leqq 2$ to produce the product CΔH, and ΔH in the equation (3) is replaced with CΔH. Then, the controller 47 calculates a preset polishing position ($H_{post\text{-}best}$) of the top ring 20 according to the equation (3) thus modified. Consequently, the equation (3) in step S107 is rewritten as follows:

$$H_{post\text{-}best} = H_{initial\text{-}best} + C\Delta H - \Delta L$$

Next, the adjustment coefficient (C) for the amount of wear (ΔH) of the polishing pad 22 may be switched from 1.0 (no adjustment) to 0.8 to 0.6. The timing and tendency of such adjustment coefficient switching will be described below.

The switching of the adjustment coefficient (C) for the amount of wear (ΔH) of the polishing pad 22 depends on the type of the polishing pad and the polishing process. Specifically, the adjustment coefficient (C) differs depending on whether the polishing pad 22 is a single-layer pad or a multilayer pad. The adjustment coefficient (C) of the multilayer pad differs depending on the materials of the upper and lower layers and the thicknesses of the upper and lower layers. The adjustment coefficient (C) of the single-layer pad is basically 1.0.

The polishing process has its polishing rate largely variable depending on whether a chemical element (chemical polishing) is dominant or a mechanical element (mechanical polishing) is dominant. The adjustment coefficient (C) is more effective if the mechanical element is dominant. The adjustment coefficient (C) may be switched while the polishing apparatus is polishing the semiconductor wafer W. If the limit amount of wear of the polishing pad is 0.6 mm, for example, then the adjustment coefficient (C) may be switched when the actual amount of wear reaches 0.3 mm well prior to the limit amount of wear. The adjustment coefficient (C) is switched such that it is progressively smaller as the polishing pad is worn, e.g., from 1.0 to 0.8 or from 0.8 to 0.6.

The above process of adjusting the amount of wear of the polishing pad is applicable to the polishing apparatus according to the embodiment shown in FIG. 8, and is also applicable to the polishing apparatus in which the top ring shaft is prevented from being elongated or any elongation of the top ring shaft is negligible. In such a case, the equation (3) in step S107 is rewritten as follows:

$$H_{post\text{-}best} = H_{initial\text{-}best} + C\Delta H$$

If the polishing pad or the polishing process is characterized in that it polishes the edge of the semiconductor wafer at a lower rate as the grooves in the surface of the polishing pad become shallower, then the adjustment coefficient (C) may be more effective if it is greater than 1. For example, the amount of wear (ΔH) of the polishing pad 22 may be multiplied by the adjustment coefficient (C) in the range of $1 < C \leqq 2$.

Next, a top ring which is suitably used as the top ring 20 in the above embodiments shown in FIGS. 1 through 8 will be described below in detail. FIGS. 9 through 12 are cross-sectional views showing an example of the top ring 20 along a plurality of radial directions of the top ring 20. FIG. 13 is a plan view showing a lower member shown in FIGS. 9 through 12.

As shown in FIGS. 9 through 12, the top ring 20 has a top ring body 200 for pressing a semiconductor wafer W against the polishing surface 22*a* and a retainer ring 302 for directly pressing the polishing surface 22*a*. The top ring body 200 includes an upper member 300 in the form of a circular plate, an intermediate member 304 attached to a lower surface of the upper member 300, and a lower member 306 attached to a lower surface of the intermediate member 304. The retainer ring 302 is attached to a peripheral portion of the upper member 300. The upper member 300 is connected to the top ring shaft 18 by bolts 308. Further, the intermediate member 304 is fixed to the upper member 300 by bolts (not shown), and the lower member 306 is fixed to the upper member 300 by bolts (not shown). The top ring body 200 including the upper member 300, the intermediate member 304, and the lower member 306 is made of resin such as engineering plastics (e.g., PEEK).

The top ring 20 has an elastic membrane 314 attached to a lower surface of the lower member 306. The elastic membrane 314 is brought into contact with a rear face of a semiconductor wafer held by the top ring 20. The elastic membrane 314 is held on the lower surface of the lower member 306 by an annular edge holder 316 disposed radially outward and annular ripple holders 318 and 319 disposed radially inward of the edge holder 316. The elastic membrane 314 is made of a highly strong and durable rubber material such as ethylene propylene rubber (EPDM), polyurethane rubber, silicone rubber, or the like.

The edge holder 316 is held by the ripple holder 318, and the ripple holder 318 is held on the lower surface of the lower member 306 by a plurality of stoppers 320. The ripple holder 319 is held on the lower surface of the lower member 306 by a plurality of stoppers 322. As shown in FIG. 13, the stoppers 320 and the stoppers 322 are arranged along a circumferential direction of the top ring 20 at equal intervals.

Figure 9:
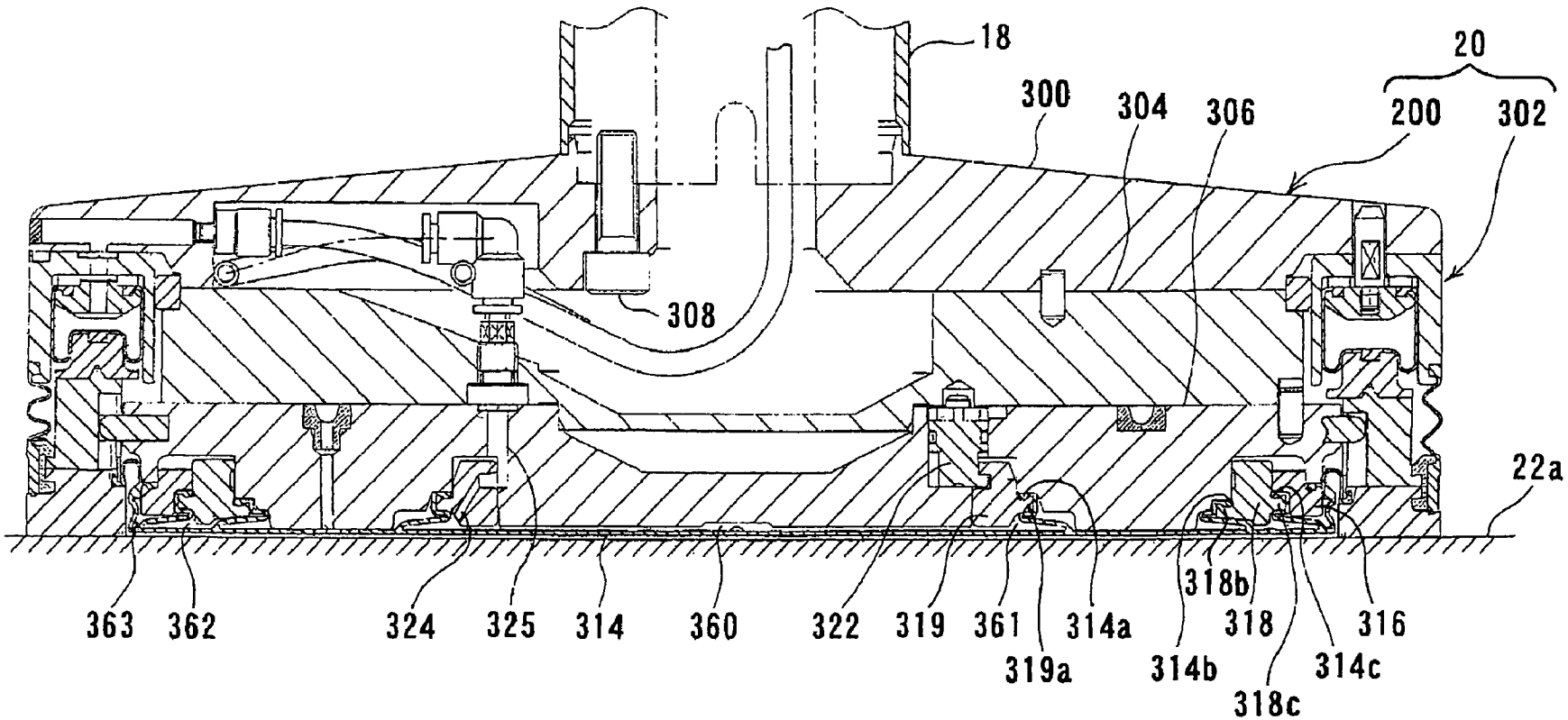
FIG. 9 is a cross-sectional view showing the top ring shown in FIG. 1.

As shown in FIG. 9, a central chamber 360 is formed at a central portion of the elastic membrane 314. The ripple holder 319 has a passage 324 communicating with the central chamber 360. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 360 formed by the elastic membrane 314.

The ripple holder 318 has claws 318*b* and 318*c* for pressing a ripple 314*b* and an edge 314*c* of the elastic membrane 314 against the lower surface of the lower member 306. The ripple holder 319 has a claw 319*a* for pressing a ripple 314*a* of the elastic membrane 314 against the lower surface of the lower member 306.

Figure 10:
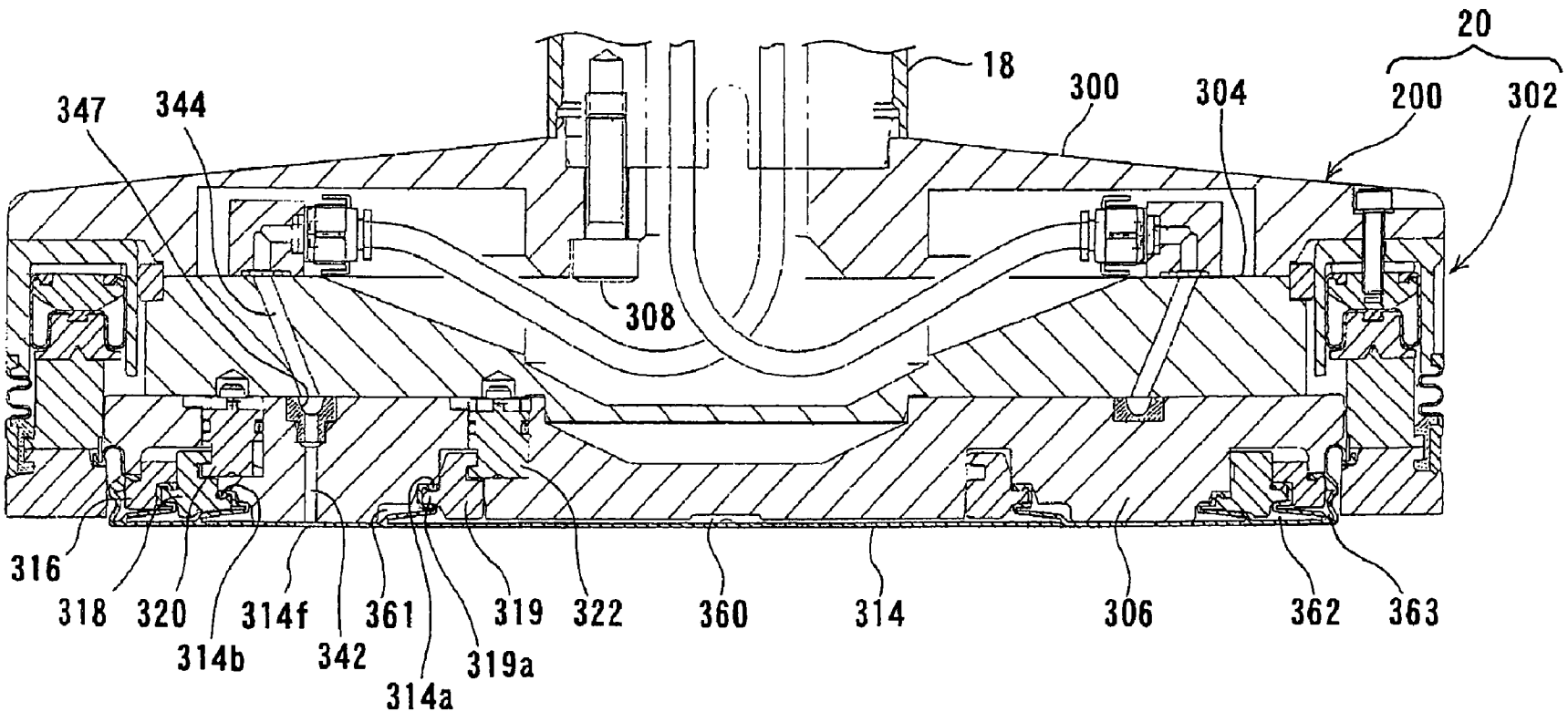
FIG. 10 is a cross-sectional view showing the top ring shown in FIG. 1.

As shown in FIG. 10, an annular ripple chamber 361 is formed between the ripple 314*a* and the ripple 314*b* of the elastic membrane 314. A gap 314*f* is formed between the ripple holder 318 and the ripple holder 319 of the elastic membrane 314. The lower member 306 has a passage 342 communicating with the gap 314*f*. Further, the intermediate member 304 has a passage 344 communicating with the passage 342 of the lower member 306. An annular groove 347 is formed at a connecting portion between the passage 342 of the lower member 306 and the passage 344 of the intermediate member 304. The passage 342 of the lower member 306 is connected via the annular groove 347 and the passage 344 of the intermediate member 304 to a fluid supply source (not shown). Thus, a pressurized fluid is supplied through the passages to the ripple chamber 361. Further, the passage 342 is selectively connected to a vacuum pump (not shown). When the vacuum pump is operated, a semiconductor wafer is attracted to the lower surface of the elastic membrane 314 by suction.

Figure 11:
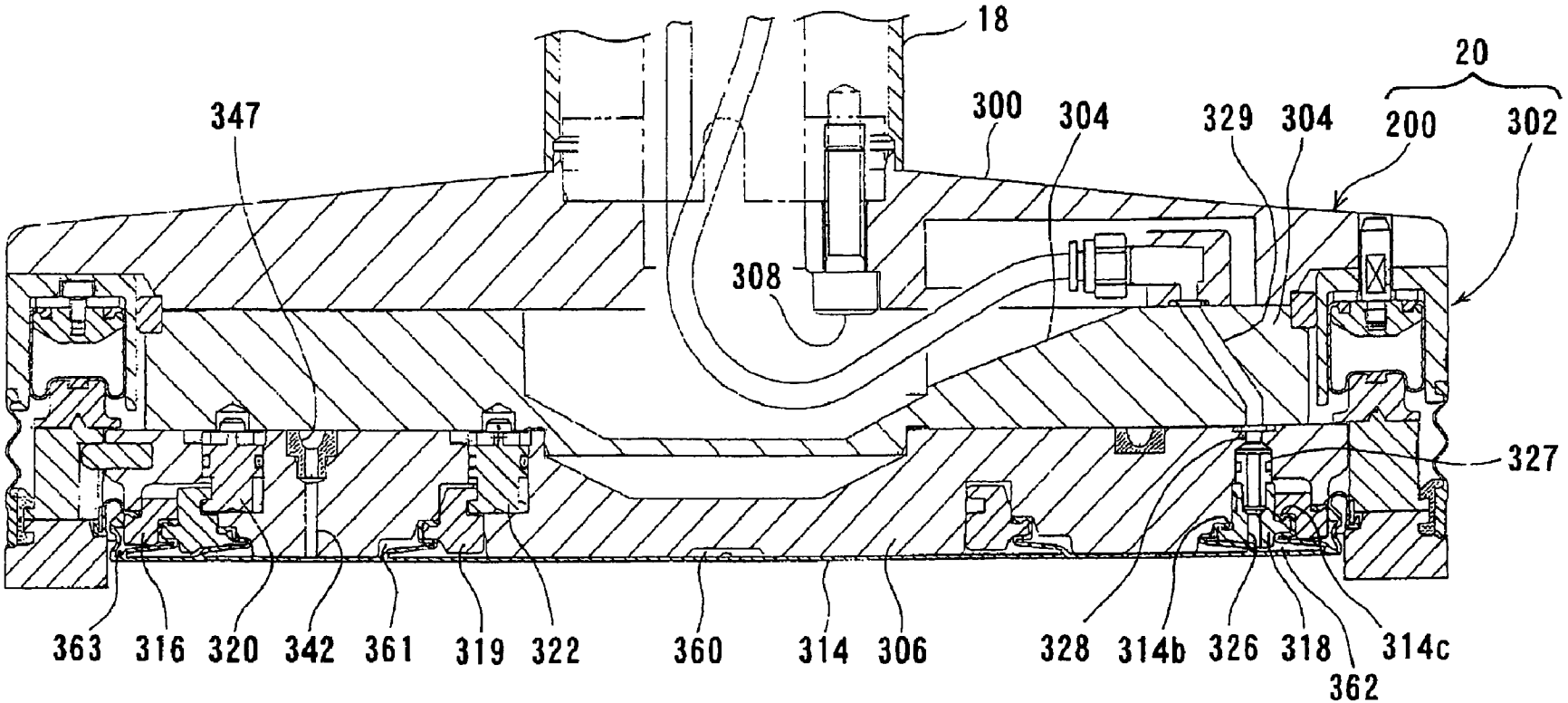
FIG. 11 is a cross-sectional view showing the top ring shown in FIG. 1.

As shown in FIG. 11, the ripple holder 318 has a passage 326 communicating with an annular outer chamber 362 formed by the ripple 314*b* and the edge 314*c* of the elastic membrane 314. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source (not shown). Thus, a pressurized fluid is supplied through the passages 329, 328, and 326 to the outer chamber 362 formed by the elastic membrane 314.

Figure 12:
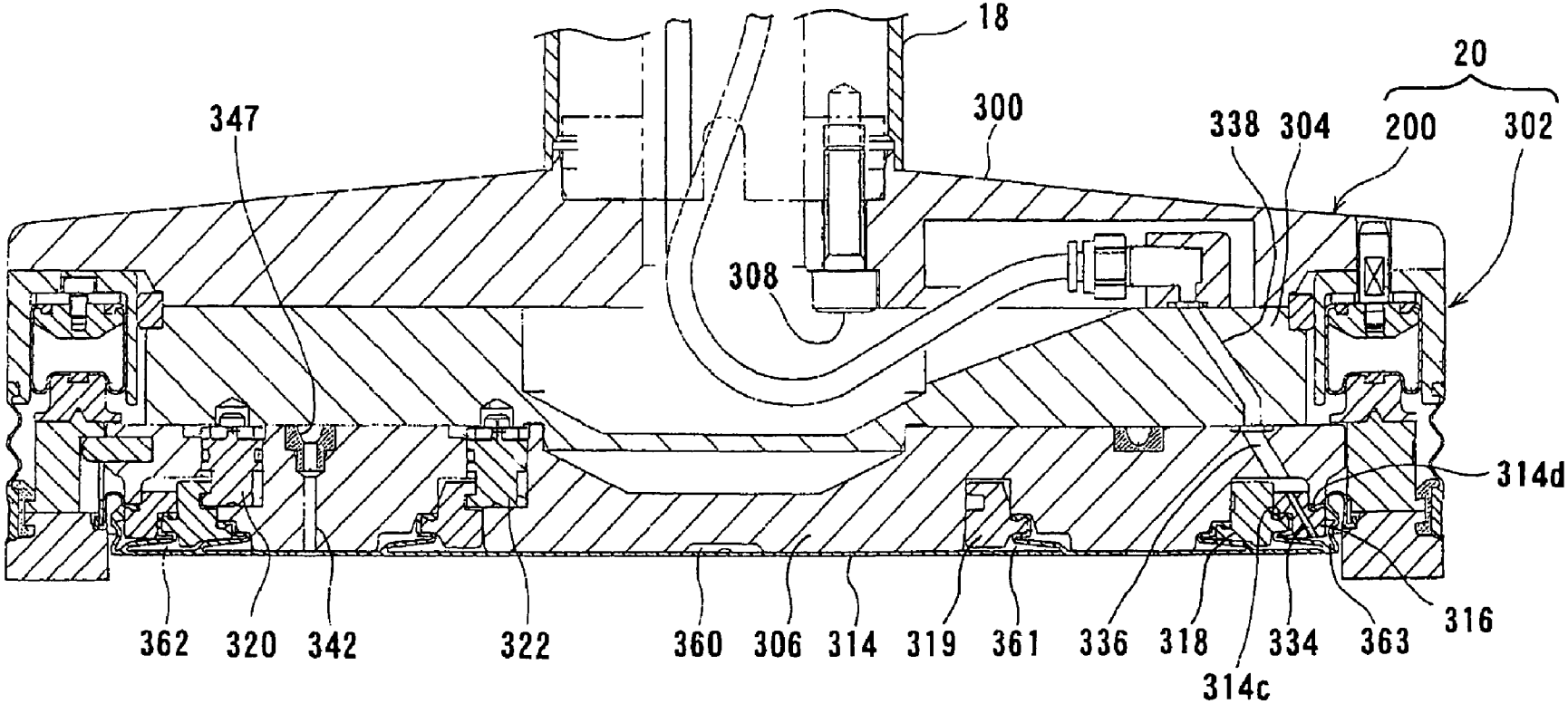
FIG. 12 is a cross-sectional view showing the top ring shown in FIG. 1.
Figure 13:
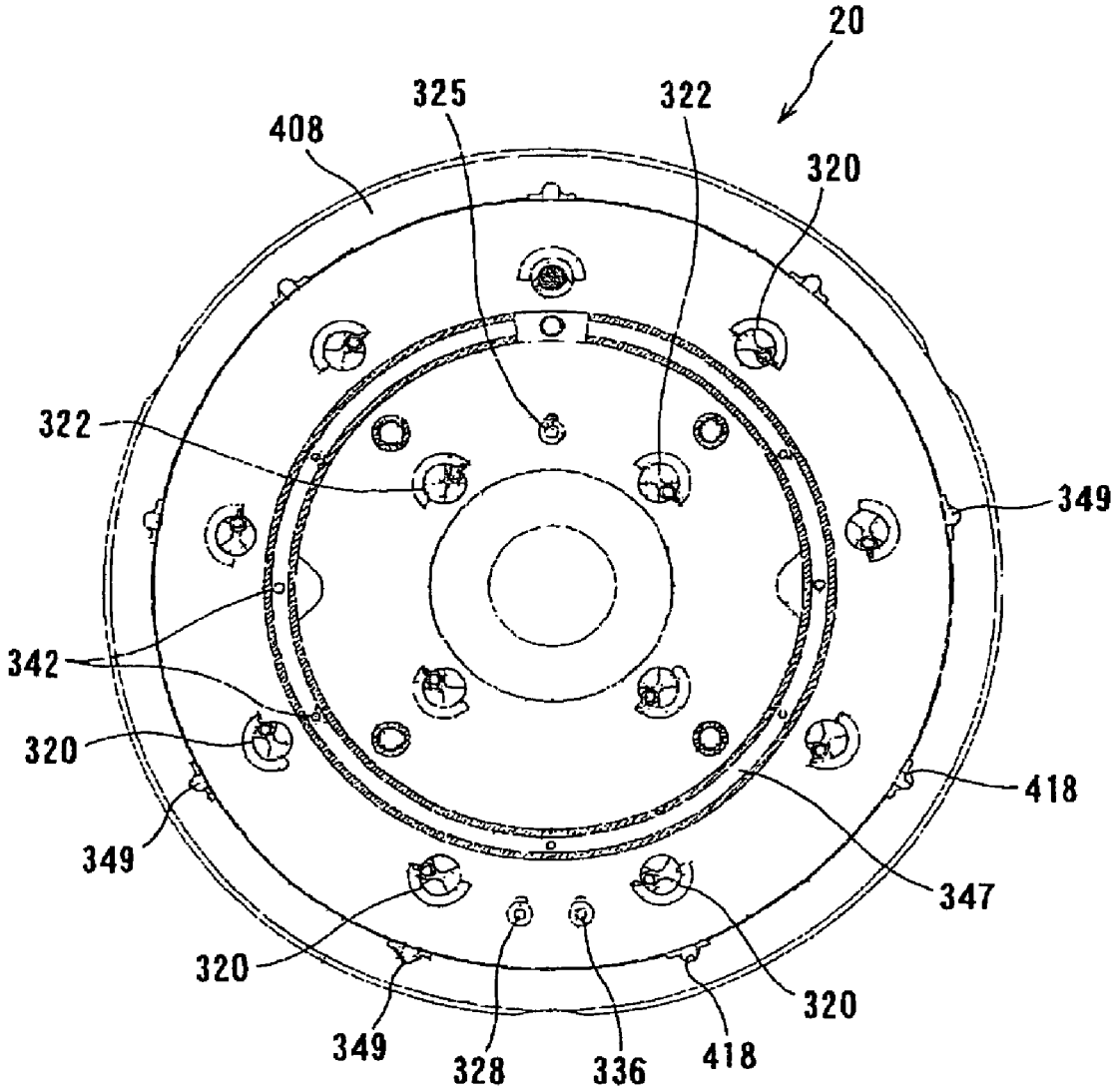
FIG. 13 is a plan view showing a lower member shown in FIGS. 9 through 12.

As shown in FIG. 12, the edge holder 316 has a claw for holding an edge 314*d* of the elastic membrane 314 on the lower surface of the lower member 306. The edge holder 316 has a passage 334 communicating with an annular edge chamber 363 formed by the edges 314*c* and 314*d* of the elastic membrane 314. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source (not shown). Thus, a pressurized fluid is supplied through the passages 338, 336, and 334 to the edge chamber 363 formed by the elastic membrane 314.

As described above, according to the top ring 20 in the present embodiment, pressing forces for pressing a semiconductor wafer against the polishing pad 22 can be adjusted at local areas of the semiconductor wafer by adjusting pressures of fluids to be supplied to the respective pressure chambers formed between the elastic membrane 314 and the lower member 306 (i.e., the central chamber 360, the ripple chamber 361, the outer chamber 362, and the edge chamber 363).

Figure 14:
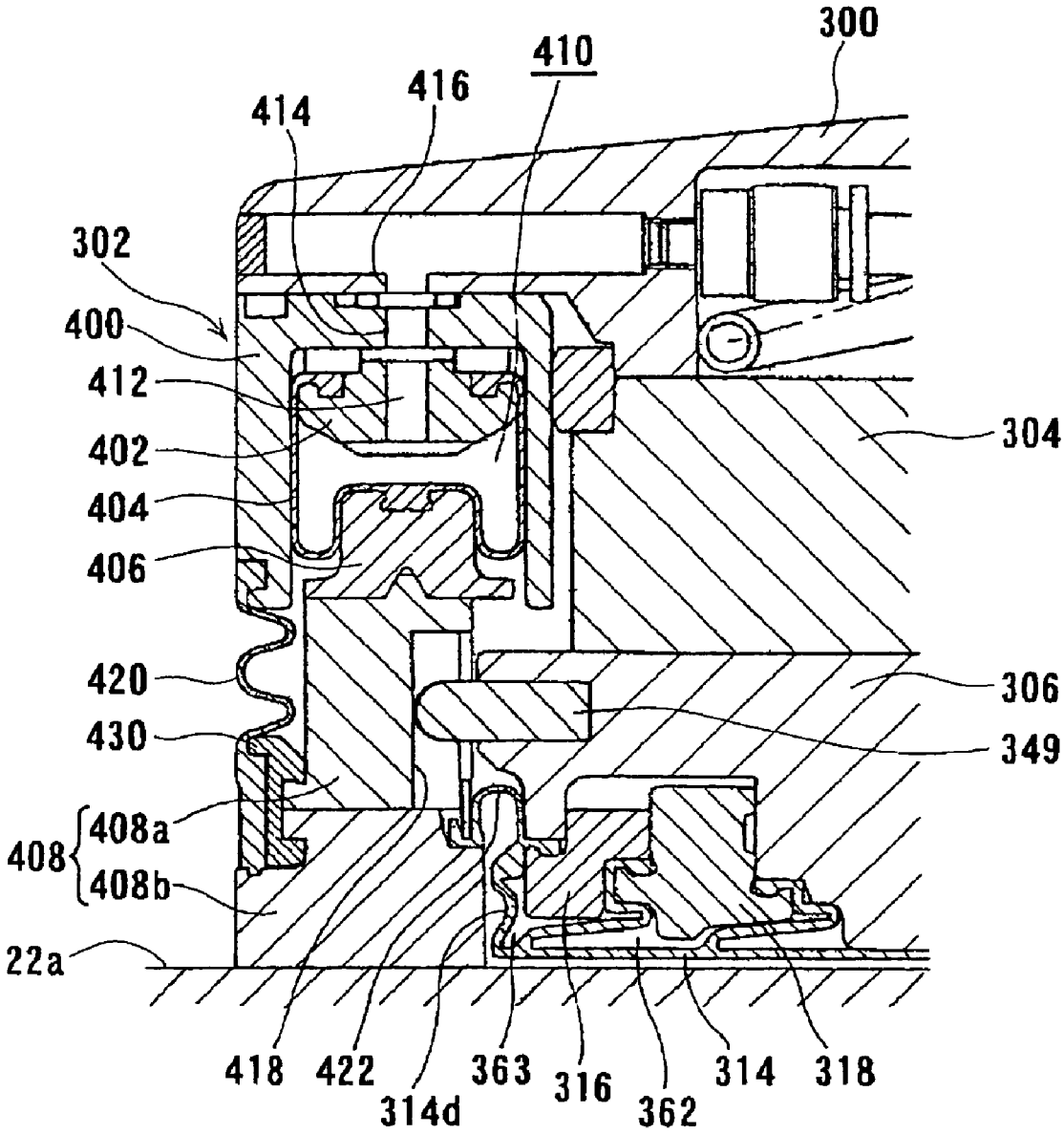
FIG. 14 is an enlarged view of a retainer ring shown in FIG. 9.

FIG. 14 is an enlarged view of the retainer ring 302 shown in FIG. 9. The retainer ring 302 serves to hold a peripheral edge of a semiconductor wafer. As shown in FIG. 14, the retainer ring 302 has a cylinder 400 having a cylindrical shape, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406. An upper end of the cylinder 400 is closed. A connection sheet 420, which can be expanded and contracted in a vertical direction, is provided between an outer circumferential surface of the ring member 408 and a lower end of the cylinder 400. The connection sheet 420 is disposed so as to fill a gap between the ring member 408 and the cylinder 400. Thus, the connection sheet 420 serves to prevent a polishing liquid (slurry) from being introduced into the gap between the ring member 408 and the cylinder 400.

The elastic membrane 314 includes a seal portion 422 connecting the elastic membrane 314 to the retainer ring 302 at an edge (periphery) 314*d* of the elastic membrane 314. The seal portion 422 has a shape curved upward. The seal portion 422 is disposed so as to fill a gap between the elastic membrane 314 and the ring member 408. The seal portion 422 is made of a deformable material. The seal portion 422 serves to prevent a polishing liquid from being introduced into the gap between the elastic membrane 314 and the ring member 408 while allowing the top ring body 200 and the retainer ring 302 to be moved relative to each other. In the present embodiment, the seal portion 422 is formed integrally with the edge 314*d* of the elastic membrane 314 and has a U-shaped cross-section.

If the connection sheet 420 or the seal portion 422 is not provided, a polishing liquid may be introduced into an interior of the top ring 20 so as to inhibit normal operation of the top ring body 200 and the retainer ring 302 of the top ring 20. In the present embodiment, the connection sheet 420 and the seal portion 422 prevent a polishing liquid from being introduced into the interior of the top ring 20. Accordingly, it is possible to operate the top ring 20 normally. The elastic membrane 404, the connection sheet 420, and the seal portion 422 is made of a highly strong and durable rubber material such as ethylene propylene rubber (EPDM), polyurethane rubber, silicone rubber, or the like.

Figure 15:
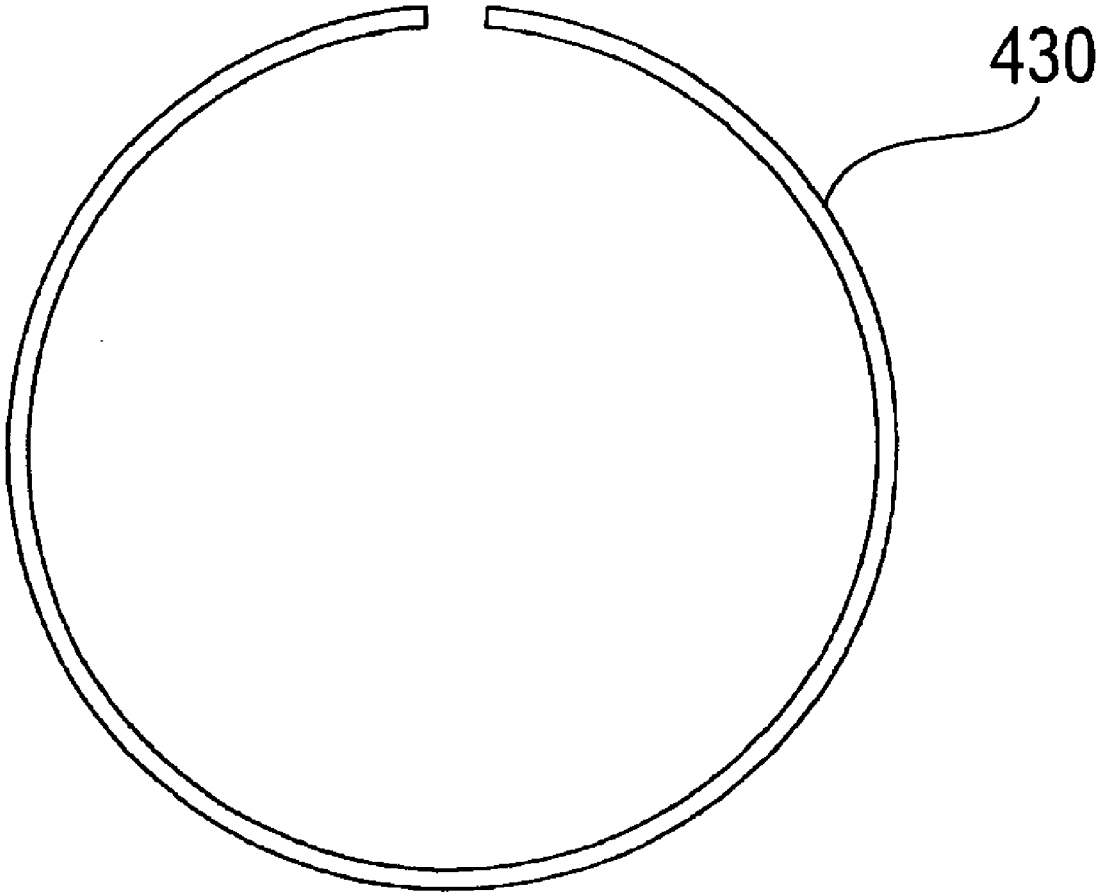
FIG. 15 is a plan view of a clamp in the retainer ring shown in FIG. 14.

The ring member 408 is divided into an upper ring member 408*a* and a lower ring member 408*b*. The upper ring member 408*a* is brought into contact with the piston 406. The lower ring member 408*b* is brought into contact with the polishing surface 22*a*. The upper ring member 408*a* and the lower ring member 408*b* have flange portions extending in a circumferential direction on outer circumferential surfaces of the ring members 408*a* and 408*b*. The flange portions are held by a clamp 430 so that the upper ring member 408*a* and the lower ring member 408*b* are fastened. FIG. 15 is a plan view of the clamp 430 shown in FIG. 14. The clamp 430 is made of a flexible material. An initial shape of the clamp 430 is substantially linear. When the clamp 430 is attached to the flange portions of the ring member 408, the clamp 430 is deformed into an annular shape having a notch as shown in FIG. 15.

Figure 16A:
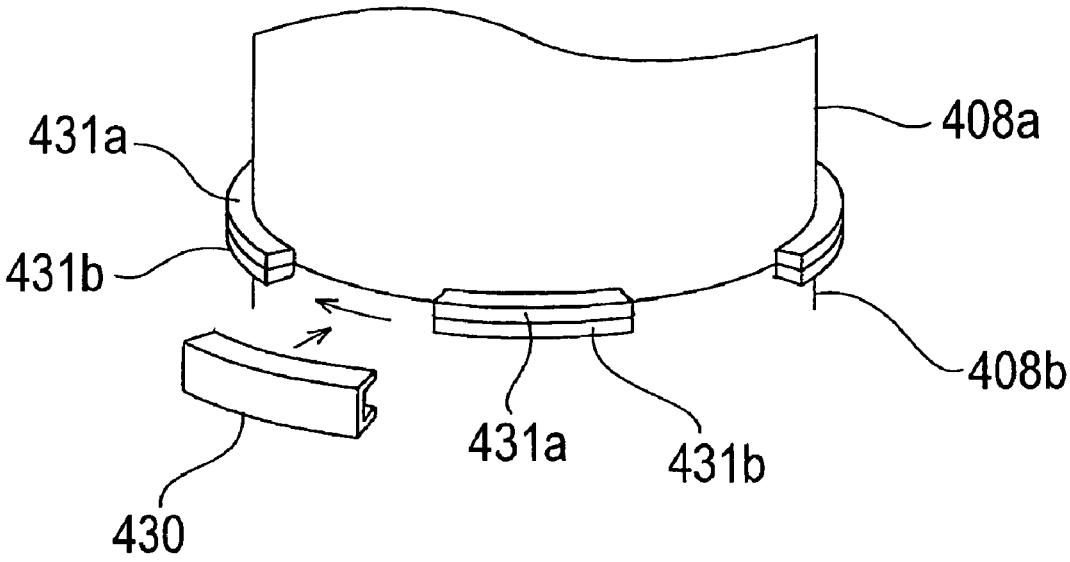
FIG. 16A is a perspective view showing another example of a clamp in the retainer ring shown in FIG. 14.

FIG. 16A is a perspective view showing another example of the clamp 430. A plurality of clamps 430 made of a hard material are used in this example. FIG. 16A shows only one of the clamps 430. The upper ring member 408*a* has a plurality of flange portions 431*a* projecting outward on an outer circumferential surface of the upper ring member 408*a*. The lower ring member 408*b* has a plurality of flange portions 431*b* projecting outward on an outer circumferential surface of the lower ring member 408*b*. Each clamp 430 has a shape curved along an outer circumferential surface of the ring member 408.

Figure 16B:
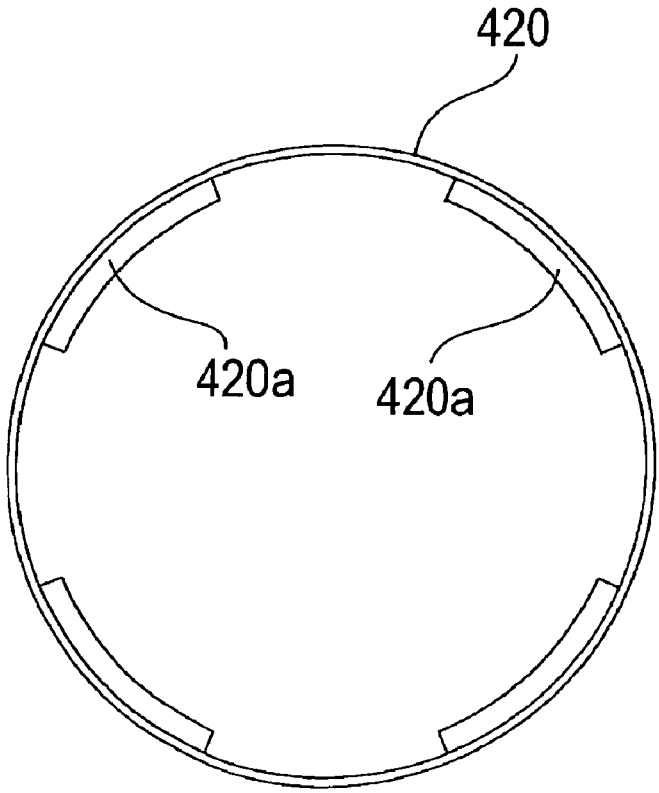
FIG. 16B is a plan view showing a connection sheet used for the clamp shown in FIG. 16A.

These clamps 430 are attached to the ring member 408 as follows. First, the upper ring member 408*a* and the lower ring member 408*b* are brought into contact with each other in a state such that the flange portions 431*a* and 431*b* are aligned with each other. Then, the clamp 430 is located at a gap between adjacent flange portions and moved horizontally to clamp the flange portions 431*a* and 431*b*. Thus, the upper ring member 408*a* and the lower ring member 408*b* are fastened to each other by the clamp 430. In this example, as shown in FIG. 16B, the connection sheet 420 has a plurality of projections 420*a* formed on an inner circumferential surface of the connection sheet 420. The projections 420*a* are fitted into gaps between the flange portions. The connection sheet 420 is attached to the ring member 408 so that the projections 420*a* are fitted into the gaps between the flange portions. Thus, the clamps 430 are fixed in place.

As shown in FIG. 14, the holder 402 has a passage 412 communicating with a chamber 410 formed by the elastic membrane 404. The cylinder 400 has a passage 414 formed at an upper portion thereof. The passage 414 of the cylinder 400 communicates with the passage 412 of the holder 402. The upper member 300 has a passage 416 communicating with the passage 414 of the cylinder 400. The passage 412 of the holder 402 is connected via the passage 414 of the cylinder 400 and the passage 416 of the upper member 300 to a fluid supply source (not shown). Thus, a pressurized fluid is supplied through the passages 416, 414, and 412 to the pressure chamber 410. Accordingly, by adjusting a pressure of a fluid to be supplied to the pressure chamber 410, the elastic membrane 404 can be expanded and contracted so as to vertically move the piston 406. Thus, the ring member 408 of the retainer ring 302 can be pressed against the polishing pad 22 under a desired pressure.

In the illustrated example, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 302 presses the polishing pad 22 can accurately be adjusted.

With the above arrangement, only the ring member 408 of the retainer ring 302 can be lowered. Accordingly, a constant distance can be maintained between the lower member 306 and the polishing pad 22 even if the ring member 408 of the retainer ring 302 is worn out. Further, since the ring member 408, which is brought into contact with the polishing pad 22, and the cylinder 400 are connected by the deformable elastic membrane 404, no bending moment is produced by offset loads. Accordingly, surface pressures by the retainer ring 302 can be made uniform, and the retainer ring 302 becomes more likely to follow the polishing pad 22.

As shown in FIGS. 13 and 14, the upper ring member 408*a* has a plurality of vertically extending V-shaped grooves 418. The V-shaped grooves 418 are formed in an inner surface of the upper ring member 408*a* at equal intervals. Further, a plurality of pins 349 project radially outward from a peripheral portion of the lower member 306. The pins 349 are arranged so as to engage with the V-shaped grooves 418 of the ring member 408. The pins 349 are vertically slidable within the V-shaped grooves 418 relative to the ring member 408. The pins 349 allow rotation of the top ring body 200 to be transmitted via the upper member 300 and the lower member 306 to the retainer ring 302 so as to integrally rotate the top ring body 200 and the retainer ring 302. Such an arrangement prevents torsion of the elastic membrane (rolling diaphragm) 404 and allows the ring member 408 to be pressed uniformly and smoothly against the polishing surface 22*a* during polishing. Further, a lifetime of the elastic membrane 404 can be prolonged.

Figure 17:
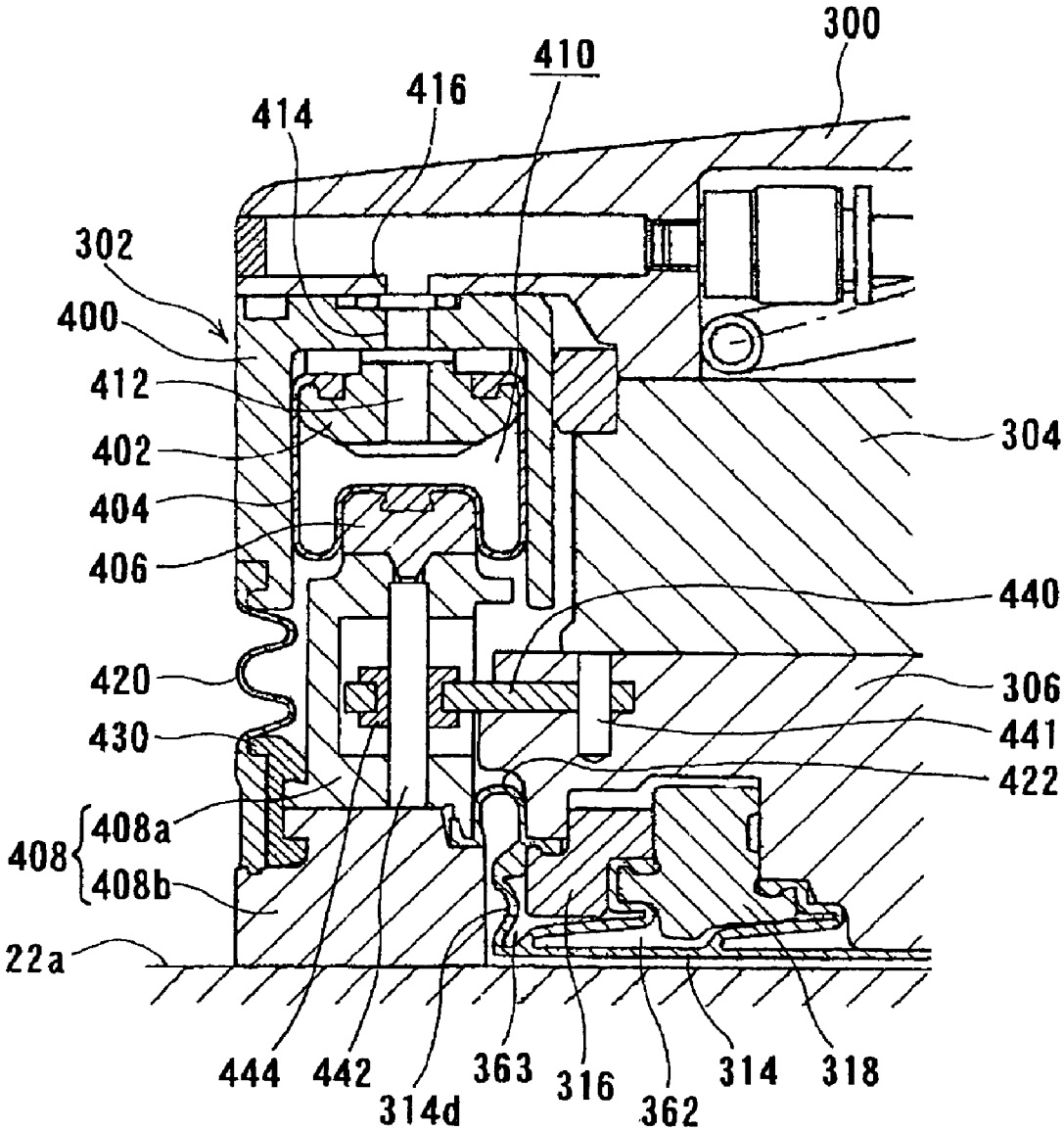
FIG. 17 is a partial cross-sectional view showing another example of a top ring.
Figure 18:
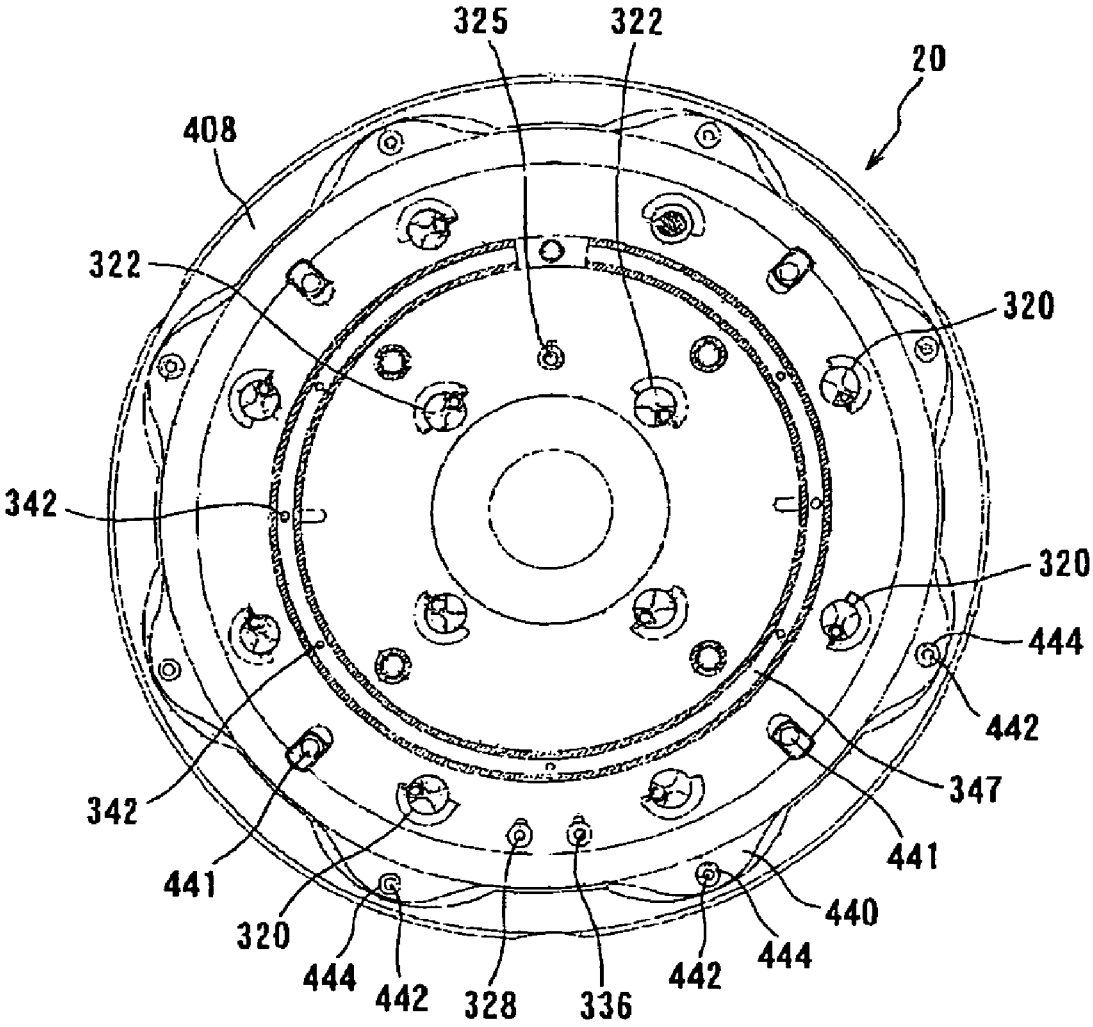
FIG. 18 is a plan view of a lower member of the top ring shown in FIG. 17.

Since rotation of the top ring body 200 is transmitted to the retainer ring 302 by engagement of the pins 349 provided on the top ring body 200 with the V-shaped grooves 418 of the retainer ring 302, the pins 349 may be brought into sliding contact with the V-shaped grooves 418 to form recesses in surfaces of the V-shaped grooves 418. Such recesses may forcibly position the pins 349 so as to cause unstable movement of the retainer ring 302. FIGS. 17 and 18 are partial cross-sectional views showing a top ring capable of resolving such a drawback.

FIG. 17 is a partial cross-sectional view showing another example of a top ring. FIG. 18 is a plan view of a lower member of the top ring shown in FIG. 17. As shown in FIGS. 17 and 18, an annular sheet member 440 is fixed to the lower member 306 of the top ring body 200 by pins 441. A plurality of slide rings 444 are attached to peripheral portions of the sheet member 440 at equal intervals. The upper ring member 408*a* of the retainer ring 302 has a plurality of drive pins 442 extending along a vertical direction at equal intervals. The drive pins 442 are inserted into the slide rings 444 so as to be slidable within the slide rings 444. Rotation of the top ring body 200 is transmitted via the sheet member 440, the slide rings 444, and the drive pins 442 to the retainer ring 302. Thus, the top ring body 200 and the retainer ring 302 are rotated integrally with each other.

In this example, since the drive pins 442 are brought into contact with the slide rings 444 with large contact areas, it is possible to reduce wear of the drive pins 442 and the slide rings 444. Accordingly, the ring member 408 can be moved smoothly in the vertical direction. Thus, it is possible to operate the retainer ring 302 normally. Rubber is suitable for a material of the sheet member 440. When the sheet member 440 is made of rubber, vibration to be transmitted between the top ring body 200 and the retainer ring 302 can be reduced.

As described above, pressing forces to press a semiconductor wafer are controlled by pressures of fluids to be supplied to the central chamber 360, the ripple chamber 361, the outer chamber 362, and the edge chamber 363 formed by the elastic membrane 314. Accordingly, the lower member 306 should be located away upward from the polishing pad 22 during polishing. However, if the retainer ring 302 is worn out, a distance between the semiconductor wafer and the lower member 306 is varied to change a deformation manner of the elastic membrane 314. Accordingly, surface pressure distribution is also varied on the semiconductor wafer. Such a variation of the surface pressure distribution causes unstable profiles of polished semiconductor wafers.

In the illustrated example, since the retainer ring 302 can vertically be moved independently of the lower member 306, a constant distance can be maintained between the semiconductor wafer and the lower member 306 even if the ring member 408 of the retainer ring 302 is worn out. Accordingly, profiles of polished semiconductor wafers can be stabilized.

In the illustrated example, the elastic membrane 314 is disposed so as to be brought into contact with substantially the entire surface of the semiconductor wafer. However, the elastic membrane 314 may be brought into contact with at least a portion of a semiconductor wafer.

Although certain preferred embodiments of the present invention have been shown and described in detail, it should be understood that various changes and modifications may be made therein without departing from the scope of the appended claims.

What is claimed is:

1. A polishing apparatus comprising:

a polishing table having a polishing surface;

a top ring configured to hold and press a substrate against said polishing surface;

a top ring shaft configured to lift and lower said top ring;

a lifting and lowering mechanism configured to lift and lower said top ring shaft;

an elongation detecting device configured to detect an elongation of said top ring shaft; and a controller configured to set a vertical position of said top ring at a time of polishing, and control said lifting and lowering mechanism to lower said top ring to a preset polishing position as the set vertical position, wherein said elongation detecting device comprises:

a temperature sensor for measuring a temperature of said top ring shaft; and a calculating device configured to calculate the elongation of said top ring shaft from a change in the temperature measured by said temperature sensor, and wherein said controller corrects the preset polishing position based on the elongation of said top ring shaft which has been detected by said elongation detecting device.

2. A polishing apparatus according to claim 1, further comprising:

a position detecting device configured to detect a vertical position of said top ring when a lower surface of said top ring or a lower surface of the substrate held by said top ring is brought into contact with said polishing surface, wherein said controller calculates the preset polishing position from the vertical position of said top ring which has been detected by said position detecting device.

3. A polishing apparatus according to claim 1, further comprising:

a dresser for dressing said polishing surface comprising a polishing pad; and a wear detecting device configured to detect an amount of wear of said polishing pad, wherein said controller corrects the preset polishing position based on the amount of wear of said polishing pad, which has been detected by said wear detecting device, and the elongation of said top ring shaft.

4. A polishing apparatus comprising:

a polishing table having a polishing surface;

a top ring configured to hold and press a substrate against said polishing surface;

a top ring shaft configured to lift and lower said top ring;

a lifting and lowering mechanism configured to lift and lower said top ring shaft;

an elongation detecting device configured to detect an elongation of said top ring shaft;

a controller configured to set a vertical position of said top ring at a time of polishing, and control said lifting and lowering mechanism to lower said top ring to a preset polishing position as the set vertical position;

a dresser for dressing said polishing surface comprising a polishing pad; and a wear detecting device configured to detect an amount of wear of said polishing pad, wherein said controller corrects the preset polishing position based on the amount of wear of said polishing pad, which has been detected by said wear detecting device, and the elongation of said top ring shaft, which has been detected by said elongation detecting device, and wherein the corrected preset polishing position (Hpost-best) which has been corrected based on the amount of wear of said polishing pad and the elongation of said top ring shaft is expressed as Hpost-best=Hinitial-best+$\Delta H-\Delta L$, where Hinitial-best represents the preset polishing position of said top ring before said polishing pad is worn, $\Delta H$ represents the amount of wear of said polishing pad, and $\Delta L$ represents the elongation of said top ring shaft.

5. A polishing apparatus comprising:

a polishing table having a polishing surface;

a top ring configured to hold and press a substrate against said polishing surface;

a top ring shaft configured to lift and lower said top ring;

a lifting and lowering mechanism configured to lift and lower said top ring shaft;

an elongation detecting device configured to detect an elongation of said top ring shaft;

a controller configured to set a vertical position of said top ring at a time of polishing, and control said lifting and lowering mechanism to lower said top ring to a preset polishing position as the set vertical position;

a dresser for dressing said polishing surface comprising a polishing pad; and a wear detecting device configured to detect an amount of wear of said polishing pad, wherein said controller corrects the preset polishing position based on the amount of wear of said polishing pad, which has been detected by said wear detecting device, and the elongation of said top ring shaft, which has been detected by said elongation detecting device, and wherein the corrected preset polishing position (Hpost-best) which has been corrected based on the amount of wear of said polishing pad and the elongation of said top ring shaft is expressed as Hpost-best=Hinitial-best+ $C\Delta H-\Delta L$, where Hinitial-best represents the preset polishing position of said top ring before said polishing pad is worn, $C\Delta H$ represents a product of the amount of wear $\Delta H$ of said polishing pad and an adjustment coefficient C in a range of $0 \leqq C < 1$ or $1 < C \leqq 2$, and $\Delta L$ represents the elongation of said top ring shaft.

6. A polishing apparatus according to claim 1, wherein said top ring includes an elastic membrane configured to contact the substrate, said elastic membrane providing a pressure chamber for being supplied with a pressurized fluid, said elastic membrane presses the substrate against said polishing surface under a fluid pressure when said pressure chamber is supplied with the pressurized fluid, and each of the preset polishing position and the corrected preset polishing position represents such a position that a gap is defined between a lower surface of the substrate held by said top ring and said polishing surface before said pressure chamber is supplied with the pressurized fluid.

7. A polishing apparatus according to claim 3, wherein said wear detecting device comprises a sensor for detecting a vertical position of said dresser when said dresser is brought in contact with said polishing pad.

8. A polishing apparatus according to claim 7, wherein said wear detecting device determines the amount of wear of said polishing pad in consideration of an elongation of a dresser shaft.

9. A polishing apparatus according to claim 2, wherein said lifting and lowering mechanism includes a motor, and said position detecting device comprises a current detector for detecting a current flowing through said motor to detect when the lower surface of said top ring or the lower surface of the substrate held by said top ring is brought into contact with said polishing surface, based on a change in the current detected by said current detector.

10. A polishing apparatus according to claim 2, wherein said top ring holds a dummy wafer as the substrate when said position detecting device detects the vertical position of said top ring.

* * * * *